US009531090B2

(12) United States Patent
Burris et al.

(10) Patent No.: US 9,531,090 B2
(45) Date of Patent: Dec. 27, 2016

(54) COAXIAL CABLE CONNECTORS WITH CONDUCTOR RETAINING MEMBERS

(71) Applicant: CORNING OPTICAL COMMUNICATIONS RF LLC, Glendale, AZ (US)

(72) Inventors: Donald Andrew Burris, Peoria, AZ (US); William Bernard Lutz, Glendale, AZ (US); Michael Ole Matzen, Vordingborg (DK); Thomas Dewey Miller, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/813,221

(22) Filed: Jul. 30, 2015

(65) Prior Publication Data

US 2016/0036138 A1 Feb. 4, 2016

Related U.S. Application Data

(60) Provisional application No. 62/030,851, filed on Jul. 30, 2014.

(51) Int. Cl.
*H01R 13/627* (2006.01)
*H01R 9/05* (2006.01)
(Continued)

(52) U.S. Cl.
CPC ..... *H01R 9/05* (2013.01); *H01R 9/053* (2013.01); *H01R 9/18* (2013.01); *H01R 13/5804* (2013.01); *H01R 13/6593* (2013.01)

(58) Field of Classification Search
CPC ..... H01R 9/05; H01R 9/0521; H01R 9/524; H01R 9/18; H01R 13/5812; H01R 13/5837; H01R 13/627; H01R 13/6272; H01R 13/6273; H01R 13/6275; H01R 13/639
(Continued)

(56) References Cited

U.S. PATENT DOCUMENTS 1,822,056 A 9/1931 Noble
2,805,399 A 9/1957 Leeper
(Continued)

FOREIGN PATENT DOCUMENTS

DE 3743636 A1 7/1999
EP 0186339 A1 7/1986
(Continued)

OTHER PUBLICATIONS

Patent Cooperation Treaty, International Search Report and Written Opinion for Application No. PCT/US2015/042771, Dated Sep. 30, 2015, 12 pages.

*Primary Examiner* — Chandrika Prasad

(57) ABSTRACT

Coaxial cables and coaxial cable connectors are disclosed. In one embodiment, a connector includes a body portion having a first end and a second end and defining a bore, a contact member having a circumferential portion and at least one protruding member, an inner sleeve, a rotatable coupling nut, and a conductor retaining member. The at least one protruding member protrudes from the circumferential portion toward the second end of the body portion and within the bore. The rotatable coupling nut is rotatably coupled to the inner sleeve and electrically coupled to the contact member. The conductor retaining member is centrally disposed within the inner sleeve, and is configured to receive an inner conductor of the co-axial cable such that the inner conductor is free to pass through the conductor retaining member in a first direction, and restricted from passing
(Continued)

through the conductor retaining member in a second direction.

25 Claims, 17 Drawing Sheets

(51) Int. Cl.
*H01R 9/18* (2006.01)
*H01R 9/053* (2006.01)
*H01R 13/58* (2006.01)
*H01R 13/6593* (2011.01)

(58) Field of Classification Search
USPC ..... 439/578, 358, 460
See application file for complete search history.

(56) References Cited

U.S. PATENT DOCUMENTS 3,058,762 A 10/1962 Howe
3,264,602 A 8/1966 Schwartz
3,571,783 A 3/1971 Lusk
3,710,005 A 1/1973 French
3,744,007 A 7/1973 Horak
3,874,709 A 4/1975 MacDonald
3,888,522 A 6/1975 Moreiras
3,963,321 A 6/1976 Burger et al.
3,980,325 A 9/1976 Robertson
4,030,741 A 6/1977 Fidrych
4,062,574 A 12/1977 Scholin
4,133,594 A 1/1979 Laverick et al.
4,146,254 A 3/1979 Turner et al.
4,243,290 A 1/1981 Williams
4,342,496 A * 8/1982 Hutter ..... G02B 6/3833 439/439
4,515,991 A 5/1985 Hutchison
4,575,274 A 3/1986 Hayward
4,583,811 A 4/1986 McMills
4,696,532 A * 9/1987 Mattis ..... H01R 9/05 439/585
4,717,355 A 1/1988 Mattis
4,739,126 A 4/1988 Gutter et al.
4,834,675 A 5/1989 Samchisen
5,007,861 A 4/1991 Stirling
5,066,248 A 11/1991 Gaver, Jr. et al.
5,160,179 A 11/1992 Takagi
5,529,522 A 6/1996 Huang
5,609,501 A 3/1997 McMills et al.
5,899,769 A 5/1999 Konetschny et al.
5,942,730 A 8/1999 Schwarz et al.
5,975,951 A 11/1999 Burris et al.
5,997,350 A 12/1999 Burris et al.
6,056,326 A 5/2000 Guest
6,089,912 A 7/2000 Tallis et al.
6,298,843 B1 10/2001 Olsen et al.
6,648,683 B2 11/2003 Youtsey
6,705,884 B1 3/2004 McCarthy
6,776,657 B1 8/2004 Hung
6,955,562 B1 * 10/2005 Henningsen ..... H01R 9/0521 439/578
7,018,235 B1 3/2006 Burris et al.
7,048,578 B2 5/2006 Rodrigues
7,182,639 B2 2/2007 Burris
7,207,839 B1 4/2007 Shelly et al.
7,288,002 B2 10/2007 Rodrigues et al.
7,331,820 B2 2/2008 Burris et al.
7,507,907 B2 3/2009 Mueller et al.
RE41,044 E 12/2009 Hung
7,635,283 B1 * 12/2009 Islam ..... H01R 9/05 439/583
7,806,725 B1 10/2010 Chen
7,824,214 B2 11/2010 Paynter
8,075,338 B1 12/2011 Montena
8,777,660 B2 * 7/2014 Chiarelli ..... H01R 13/59 439/584
8,888,526 B2 11/2014 Burris
9,287,659 B2 3/2016 Burris et al.
9,407,016 B2 8/2016 Burris
2004/0031144 A1 2/2004 Holland
2009/0111323 A1 4/2009 Burris et al.
2012/0142207 A1 6/2012 Duval et al.
2012/0211274 A1 8/2012 Drotleff et al.
2014/0322968 A1 10/2014 Burris
2014/0342605 A1 11/2014 Burris et al.

FOREIGN PATENT DOCUMENTS

EP 0476056 6/1995
FR 1312525 A 12/1962
GB 2077053 A 12/1981

* cited by examiner

COAXIAL CABLE CONNECTORS WITH CONDUCTOR RETAINING MEMBERS

PRIORITY APPLICATION

This application claims the benefit of priority under 35 U.S.C. §119 of U.S. Provisional Application Ser. No. 62/030,851 filed on Jul. 30, 2014 the content of which is relied upon and incorporated herein by reference in its entirety.

BACKGROUND

The present disclosure relates generally to coaxial connectors and, more particularly, to coaxial connectors and cables assemblies with conductor retaining members that require minimal coaxial cable preparation.

Coaxial cable connectors, such as F-connectors, are used to attach coaxial cables to another object such as an appliance or junction having a terminal adapted to engage the connector. For example, F-connectors are often used to terminate a drop cable in a cable television system. The coaxial cable typically includes an inner conductor surrounded by a dielectric layer, which is in turn surrounded by a conductive grounding foil and/or braid defining a conductive grounding sheath. The conductive grounding sheath is itself surrounded by a protective outer jacket. The F-connector is typically secured over the prepared end of the jacketed coaxial cable, allowing the end of the coaxial cable to be connected with a terminal block, such as by a threaded connection with a threaded terminal of a terminal block.

Crimp style F-connectors are connectors wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable.

Still another form of F-connector uses an annular compression sleeve to secure the F-connector over the prepared end of the cable. Rather than crimping a crimp sleeve radially toward the jacket of the coaxial cable, these F-connectors employ a plastic annular compression sleeve that is initially attached to the F-connector, but which is detached therefrom prior to installation of the F-connector. The compression sleeve includes an inner bore for following such compression sleeve to be passed over the end of the coaxial cable prior to installation of the F-connector. The end of the coaxial cable must be prepared by removing a portion of the outer braid and/or folding the outer braid back over the cable jacket. The F-connector itself is then inserted over the prepared end of the coaxial cable.

The difficult step of flaring and folding the outer braid over the outer jacket is a time consuming and difficult process. Further, small fragments of the outer braid may break off. These small fragments may cause electrical shorts in nearby electrical systems and/or enter the skin of cable installer. Additionally, the necessity of tools to connect the connector to the cable is undesirable.

Accordingly, alternative connectors that do not require the use of tools and also do not require that the outer braid be folded over the jacket may be desired.

SUMMARY

Embodiments of the present disclosure are directed to coaxial cable connectors that may be connected to a coaxial cable without the use of tools and without requiring that a braided outer connector layer be folded over an outer jacket layer of the coaxial cable. Only the inner connector of the coaxial cable is exposed during cable preparation. More specifically, upon insertion of a coaxial cable into the connector, a conductor retaining member contacts the inner conductor and retains the cable within the connector. Further, upon insertion of a coaxial cable into the connector, a protrusion member is interposed in an end-wise fashion between the braided outer conductor layer and the outer layer of the coaxial cable. A means for a continual ground path from the cable outer conductor grounding structure to the rotatable coupler of the connector is provided. A means for compressing the outer layer of the coaxial cable against the braided outer conductor layer and the protrusion member is also provided.

In one embodiment, a connector for connecting to a co-axial cable includes a body portion having a first end and a second end defining a bore, a contact member having a circumferential portion and at least one protruding member, an inner sleeve, a rotatable coupling nut, and a conductor retaining member. The contact member is electrically conductive. An outer surface of the circumferential portion of the contact member is at least partially disposed within the bore at the first end of the body portion, and the at least one protruding member protrudes from the circumferential portion toward the second end of the body portion and within the bore. The inner sleeve is at least partially disposed within the circumferential portion of the contact member. The rotatable coupling nut is rotatably coupled to the inner sleeve, wherein the rotatable coupling nut is electrically conductive and is electrically coupled to the contact member. The conductor retaining member is centrally disposed within the inner sleeve, and is configured to receive an inner conductor of the co-axial cable such that the inner conductor is free to pass through the conductor retaining member in a first direction toward the first end of the body portion, and is restricted from passing through the conductor retaining member in a second direction away from the rotatable coupling nut.

In another embodiment, a co-axial cable assembly includes a coaxial cable and at least one connector coupled to an end of the co-axial cable. The coaxial cable includes an inner conductor positioned on an axis of the co-axial cable, an insulator layer surrounding the inner conductor, a braided outer conductor layer surrounding the insulator layer, and an outer layer surrounding the braided outer conductor layer. An end portion of the inner conductor is exposed beyond the insulator layer, the braided outer conductor layer, and the outer layer. The at least one connector includes a body portion, a contact member, an inner sleeve, a rotatable coupling nut, and a conductor retaining member. The body portion includes a first end and a second end defining a bore. A portion of the inner conductor, the insulator layer, the braided outer conductor layer, and the outer layer is disposed within the body portion. The contact member includes a circumferential portion and at least one protruding member. The contact member is electrically conductive, and an outer surface of the circumferential portion is at least partially disposed within the bore at the first end of the body portion. The at least one protruding member protrudes from the circumferential portion toward the second end of the body portion within the bore and extends into the braided outer conductor layer and between the insulator layer and the outer layer of the co-axial cable. The inner sleeve is at least partially disposed within the circumferential portion of the contact member. The rotatable coupling nut is rotatably coupled to the inner sleeve and nut is electrically conductive.

The rotatable coupling nut is electrically coupled to the contact member. The inner conductor of the co-axial cable is disposed within the rotatable coupling nut. The conductor retaining member is centrally disposed within the inner sleeve, wherein the inner conductor of the co-axial cable is positioned through the conductor retaining member such that the inner conductor is restricted from passing through the conductor retaining member in a direction away from the rotatable coupling nut.

In yet another embodiment, a connector for connecting to a co-axial cable includes a body portion, a contact member, an inner sleeve, a rotatable coupling nut, and a conductor retaining member. The body portion has a first end and a second end defining a bore. The contact member includes a circumferential portion having a first end and a second end, a plurality of protruding members protruding from the first end of the circumferential portion into the bore defined by the body portion, and a plurality of contacting tabs extending from the second end of the circumferential portion. The contact member is electrically conductive, and an outer surface of the circumferential portion is at least partially disposed within the bore at the first end of the body portion. The inner sleeve is at least partially disposed within the circumferential portion of the contact member. The rotatable coupling nut is rotatably coupled to the inner sleeve and includes an interior surface. The rotatable coupling nut is electrically conductive. The plurality of contacting tabs contact the interior surface of the rotatable coupling nut. The conductor retaining member is centrally disposed within the inner sleeve. The conductor retaining member is configured to receive an inner conductor of the co-axial cable such that the inner conductor is free to pass through the conductor retaining member in a first direction toward the first end of the body portion, and is restricted from passing through the conductor retaining member in a second direction away from the rotatable coupling nut.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

The accompanying drawings are included to provide a further understanding, and are incorporated in and constitute a part of this specification. The drawings illustrate one or more embodiment(s), and together with the description serve to explain principles and operation of the various embodiments.

BRIEF DESCRIPTION OF THE DRAWINGS

FIGS. 8A'-8F' schematically depict side views of the plurality of conductor retaining members depicted in FIGS. 8A-8F;

DETAILED DESCRIPTION

Embodiments of the present disclosure are directed to coaxial cable connectors capable of being installed on a coaxial cable with limited preparation of the coaxial cable. More specifically, the coaxial cable connectors described herein do not require that the braided outer conductor layer of the coaxial cable be folded back over the outer jacket. Rather, only the inner conductor of the coaxial cable may be exposed at the stripped portion of the cable. Further, the installation of coaxial cable into the connector does not require the use of secondary compression or activation tools, although such tools may be used in some embodiments. As described in more detail below, a conductor maintaining member contacts the inner conductor and prevents the coaxial cable connector from being pulled off of the coaxial cable. Various embodiments of connectors and coaxial cable assemblies are described in detail below.

Figure 1:
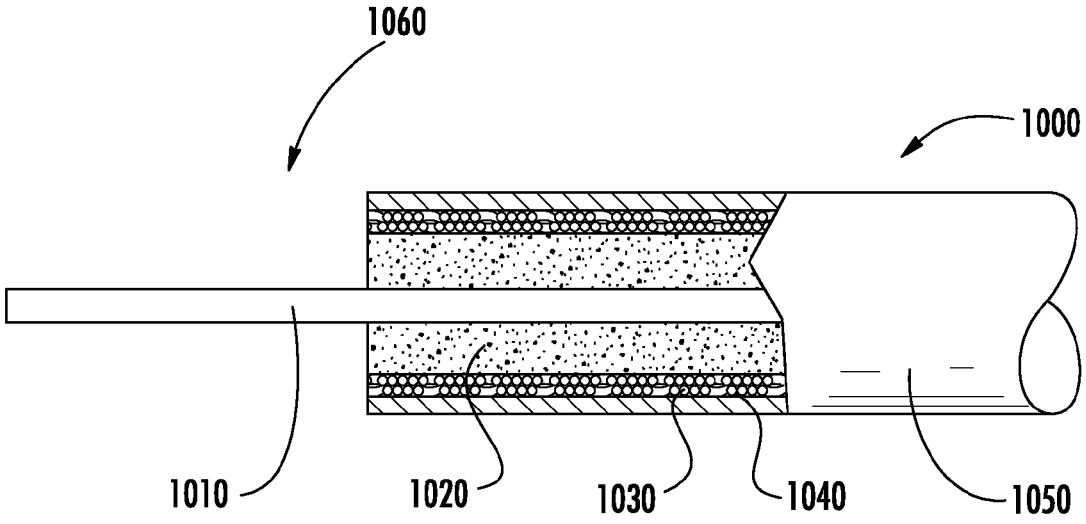
FIG. 1 schematically depicts a partial cross section view of a prepared coaxial cable according to one or more embodiments described and illustrated herein.

Referring now to FIG. 1, an example coaxial cable 1000 is schematically illustrated in a partial cross-sectional view. The example coaxial cable 1000 comprises an inner conductor 1010 surrounded by an insulator layer 1020. The insulator layer 1020 may also have a foil or other metallic covering 1030 in some embodiments. The coaxial cable 1000 further comprises a braided outer conductor layer 1040 which is covered and protected by an outer layer 1050 (i.e., a cable jacket).

FIG. 1 further illustrates a stripped portion 1060 of the coaxial cable 1000 that results from a cable stripping process. Only the inner conductor 1010 of the coaxial cable 1000 is exposed in the stripped portion 1060 having a predetermined length. Because only the inner conductor 1010 is exposed, and the braided outer conductor layer 1040 does not need to be prepared by folding it back over the outer layer 1050, preparation of the coaxial cable 1000 is fast and efficient. Moreover, preparation of the coaxial cable 1000 in this manner eliminates many of the issues related to errant strands of the braided outer conductor layer 1040 that may be present when flaring and folding the braided outer conductor layer 1040.

Figure 2A:
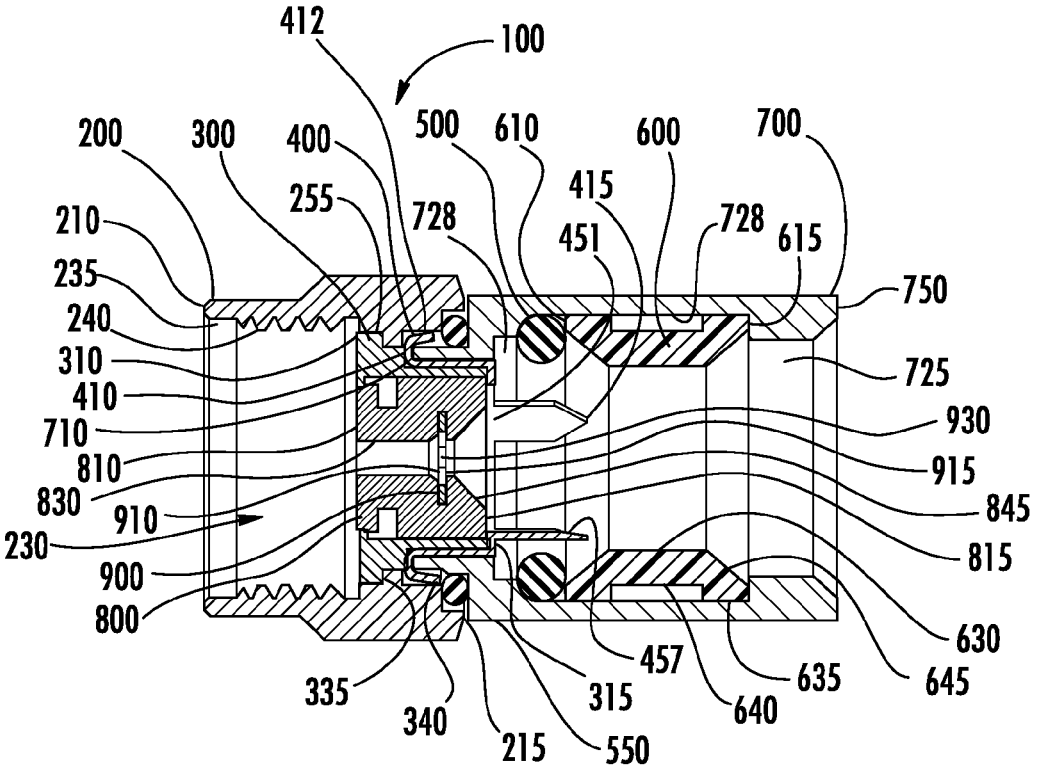
FIG. 2A schematically depicts a cross sectional view of an example coaxial cable connector according to one or more embodiments described and illustrated herein.

Referring now to FIG. 2A, an example connector 100 for connecting to a coaxial cable is schematically illustrated in cross section. The coaxial cable connector 100 generally comprises a rotatable coupling nut 200, an inner sleeve 300, a contact member 400, a body portion 700, an insulator member 800, and a conductor retaining member 900. As described in more detail below, embodiments may optionally include a pressure member 500 and a seal 600.

Still referring to FIG. 2A, the rotatable coupling nut 200 has a front end 210, a rear end 215, and an opening 230 extending there between. The opening 230 of the rotatable coupling nut 200 has an internal surface 235 that includes a threaded portion 240 for engaging a corresponding threaded portion of a mated connector. The rotatable coupling nut 200 further includes an inwardly projecting ring 255 to engage a rearward facing annular surface 335 of the inner sleeve 300.

The rotatable coupling nut 200 may be made from any electrically conductive material. As a non-limiting example, the rotatable coupling nut is made from a metallic material, such as brass, and is plated with a conductive, corrosion-resistant material, such as nickel.

The inner sleeve 300 has a front end 310 and a rear end 315. Extending between the front end 310 and the rear end 315 is an internal surface 330. A rearward facing annular surface 335 serves to rotatably retain the rotatable coupling nut 200.

The contact member 400 has a front end 410 and a rear end 415. Extending between the front end 410 and the rear end 415 is an internal surface 430. The contact member 400 further comprises a bore 451, a plurality of contacting members 412 extending outwardly at the front end 410, and at least one protruding member 457 protruding from the rear end 415. As described in more detail below, the contact member 400 electrically couples the rotatable coupling nut 200 to the braided outer conductor layer 1040 of the coaxial cable 1000 through the protruding members 457 and the contacting members 412. The protruding members 457 pierce the braided outer conductor layer 1040 of the coaxial cable 1000 and the contacting members 412 are flared outwardly such that they contact an inner surface of the rotatable coupling nut 200. In the illustrated embodiment, an outer surface 340 of the inner sleeve 300 engages the contact member 400 by a press fit. It should be understood that other coupling methods may also be utilized. The contact member 400 may be made from any electrically conductive material. For example, the contact member 400 may be made from a metallic material, such as brass, and plated with a conductive, corrosion-resistant material, such as tin. However, the contact member 400 may be made from any appropriate material.

The pressure member 500 (also referred to herein as a "compression member") is an optional component comprising various forms as will be shown in alternate embodiments herein. The pressure member 500 is a component that is configured to apply pressure to the outer layer 1050 of the coaxial cable 1000 to enhance electrical connection between the protruding members 457 of the contact member 400 and the braided outer conductor layer 1040 of the coaxial cable 1000. In the embodiment depicted in FIG. 2A, the pressure member 500 is in the form of an o-ring having an outside diameter 510, an inside diameter 515 and a cross sectional diameter 520. The pressure member 500 may be made from any compressible, rubber-like material such as ethylene propylene diene monomer (EPDM). It should be understood that the pressure member 500 may be made from any other appropriate material.

An optional seal 600 has a front end 610 and a rear end 615. Extending between the front end 610 and the rear end 615 is an internal surface 630. The seal 600 further comprises an outer diameter 635, an outer relief 640, and tapered portions 645. The seal 600 may made from a rubber-like material, such as silicone, but may be made from any appropriate material.

Figure 3A:
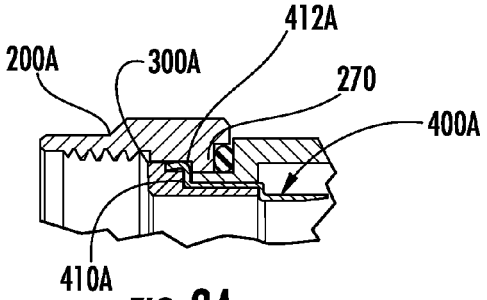
FIGS. 3A-3F schematically depict cross sectional views of alternative embodiments of a continual ground path from a braided outer conductor layer of a coaxial cable to a rotatable coupling nut of a coaxial cable connector according to one or more embodiments described and illustrated herein.

The body portion 700 has an internal surface 715 that extends between the front end 710 and the rear end 750 and defines a longitudinal opening 725. The body portion 700 also has an inner surface 720 to engage the contact member 400, and a recess 728. As shown in FIG. 3A, the seal 600 is disposed within the recess 728 and is operable to prevent liquids and debris from entering the connector 100. The body portion 700 may be made from plastic, such as acetal, but may be made from any appropriate material such as brass that is plated with a conductive, corrosion-resistant material, such as nickel.

The insulator member 800 has a front end 810 and a rear end 815. Extending between the front end 810 and the rear end 815 is an internal surface 830. The insulator member 800 further comprises an inner diameter 835, an outer diameter 840, and an internal bore 845. The internal bore 845 may have a tapered portion to assist in guiding the inner conductor 1010 of the coaxial cable 1000 into the conductor retaining member 900. In the illustrated embodiment, the insulator member 800 maintains the conductor retaining member 900. The insulator member 800 may be made as a multi-part construction in a clam-shell type configuration (see FIGS. 12A-12F). Alternatively, the insulator member 800 may be molded about conductor retaining member 900 by insert molding. In still other embodiments, the conductor retaining member 900 is integral with insulator member 800 or the conductor retaining member 900 is disposed within the connector 100 by other means. The insulator member 800 may be made from plastic, such as acetal, but may be made from any appropriate, non-electrically conductive material.

The conductor retaining member 900 has an aperture 930 between a front surface 910 and a rear surface 915. As described in more detail below with reference to FIGS. 2B-2D, the conductor retaining member 900 may take on any form such that it is capable of allowing movement of the inner conductor 1010 through the aperture 930 in an insertion direction indicated by arrow A (i.e., a first direction), and prevent or resist movement of the inner conductor 1010 through the aperture 930 in a second, opposite direction from the insertion direction. Accordingly, conductor retaining member 900 may be made in a number of configurations designed to retain the inner conductor 1010 and engage the insulator member 800. It is noted that example conductor retaining member 900 configurations are depicted in FIGS. 8A-11B and are described in detail below.

The conductor retaining member 900 may be made from a metallic material, such as stainless steel, phosphor bronze, or beryllium copper, and may be plated with a corrosion-resistant material, such as tin or nickel. Alternatively, the conductor retaining member 900 is made from a rigid plastic or any other appropriate material.

The o-ring 550 is an optional component that is disposed between the rotatable coupling nut 200 and the body portion 700. The o-ring 550 may be provided to prevent environmental items such as moisture and dirt from entering the connector 100. The o-ring 550 may be made from a pliable rubber-like material such as ethylene propylene diene monomer (EPDM). However, the o-ring 550 may be made from any appropriate material.

Figure 2B:
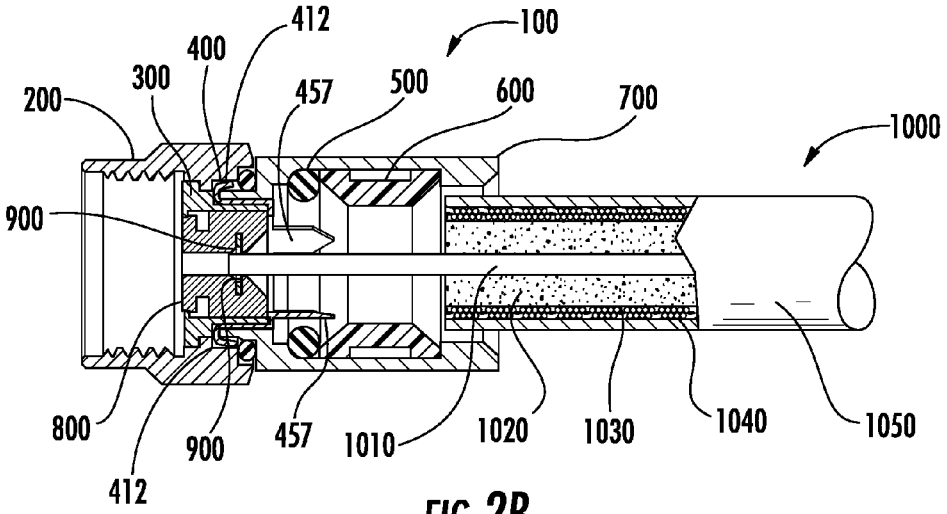
FIG. 2B schematically depicts a cross sectional view of the example coaxial cable connector depicted in FIG. 2A with a coaxial cable partially inserted therein according to one or more embodiments described and illustrated herein.

The assembly of coaxial cable connector 100 with coaxial cable 1000 will now be discussed with reference to FIGS. 2A-2C. Referring specifically to FIG. 2B, a prepared coaxial cable 1000 (e.g., as shown in FIG. 1) is partially inserted through the longitudinal opening 725 of the body portion 700. The inner conductor 1010 is guided by the tapered portion of the insulator member 800 such that it approaches the aperture 930 of the conductor retaining member 900. The act of cable insertion is improved by not having the braided outer conductor layer 1040 exposed and folded back over the outer layer 1050. The amount of clearance between the coaxial cable 1000 and the connector 100 components allow the coaxial cable 1000 to easily enter the connector 100.

The inner conductor 1010 is pushed through the aperture 930 of the conductor retaining member 900, sliding past flexible protrusions 940 (or fingers) defined by radial openings of the conductor retaining member 900, causing the protrusions 940 to flex in a direction towards the connector interface 105 in one embodiment (see FIGS. 8A-8F for example conductor retaining member configurations). Once the inner conductor 1010 engages the protrusions 940, it cannot be retracted in a direction opposite from the insertion direction without inverting the protrusions 940 to the reverse side of their original starting position, which requires a high degree of force. Thus, the inner conductor 1010 is directionally captured to achieve cable retention within the connector 100. The retaining force of the conductor retaining member 900 upon the copper clad steel inner conductor 1010 is high such that it prevents the connector 100 from being pulled off of the coaxial cable 1000. Insertion of the coaxial cable 1000 into the connector 100 may be accomplished completely by hand without the need for a secondary compression tool. However, such secondary compression tools may be utilized in some embodiments and depending on the particular style of the connector 100.

Figure 2C:
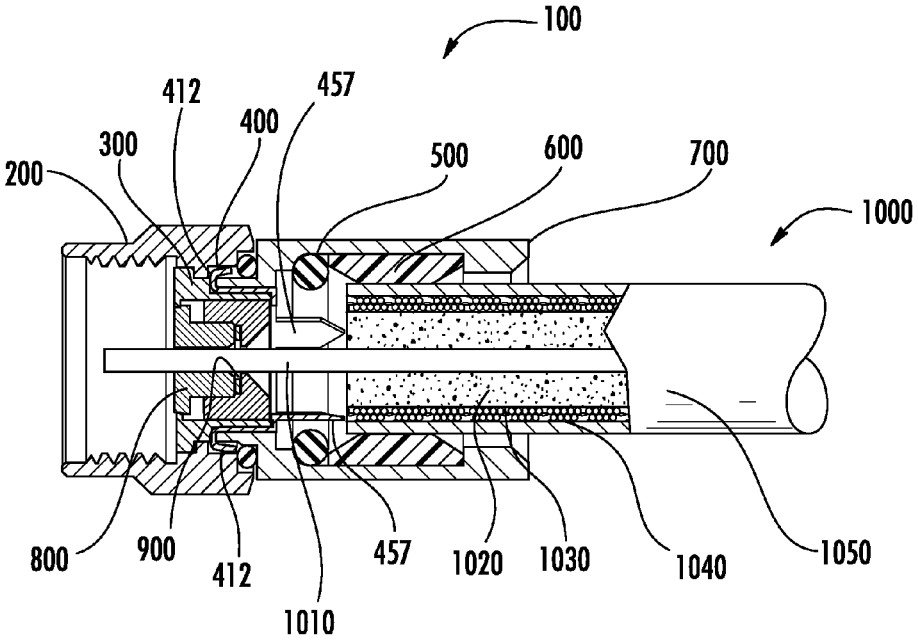
FIG. 2C schematically depicts a cross sectional view of the example coaxial cable connector depicted in FIGS. 2A and 2B with a coaxial cable further partially inserted therein according to one or more embodiments described and illustrated herein.

FIG. 2C is a partial cross sectional view of the connector 100 of FIG. 2A wherein the coaxial cable 1000 is further partially inserted into the connector 100. The inner conductor 1010 is advanced to protrude beyond the front end 810 of the insulator member 800 while the outer layer 1050 of the coaxial cable 1000 enters the seal 600. The outer relief 640 of the seal 600 gives way to allow the coaxial cable 1000 to more easily enter the connector 100. The circumferentially arranged protruding members 457 of the contact member 400 are positioned to coaxially align with the face of the braided outer conductor layer 1040.

Figure 2D:
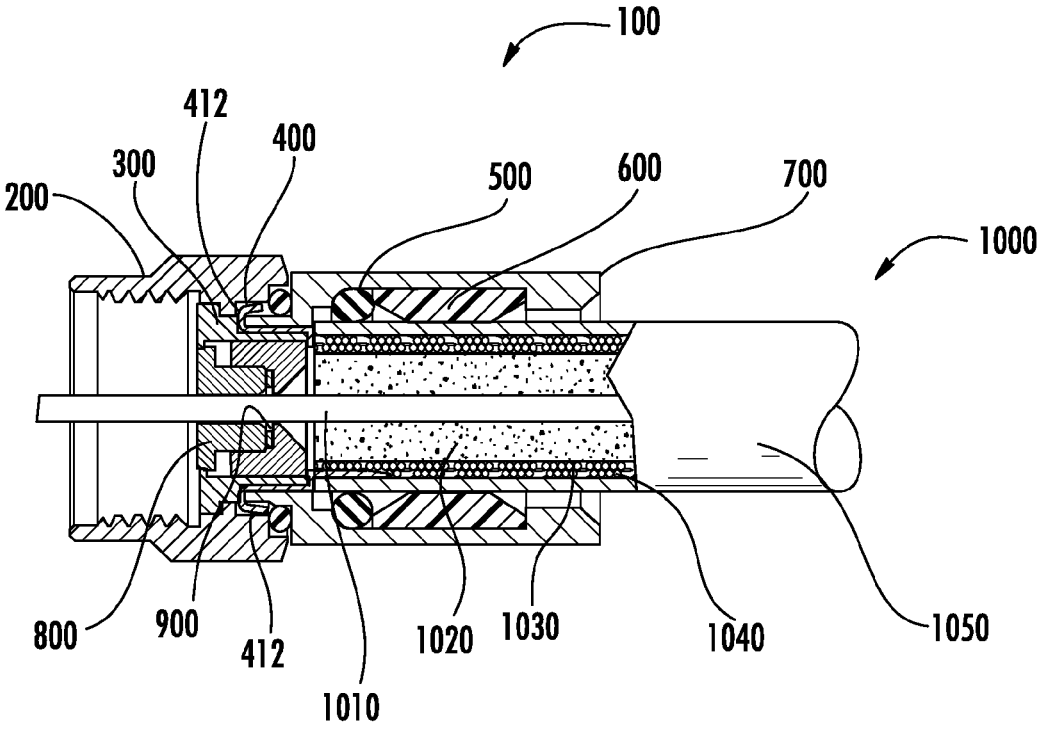
FIG. 2D schematically depicts a cross sectional view of the example coaxial cable connector depicted in FIGS. 2A-2C with a coaxial cable fully inserted therein according to one or more embodiments described and illustrated herein.

FIG. 2D is a partial cross sectional view of the connector 100 of FIG. 2A wherein the coaxial cable 1000 is fully inserted into the connector 100. The inner conductor 1010 is advanced to protrude beyond the front end 210 of the rotatable coupling nut 200. The protruding members 457 pierce the front face of the braided outer conductor layer 1040 such that they are interposed between the outer layer 1050 and the braided outer conductor layer 1040. Alternatively, or coincidently, the protruding members 457 may be interposed between the metallic covering 1030, the braided outer conductor layer 1040 and the outer layer 1050. Accordingly, the protruding members 457, the contacting members 412 and the body of the contact member 400 provide a transfer of the ground path from the braided outer conductor layer 1040 of the coaxial cable to the rotatable coupling nut 200 of the connector 100. Specifically, the ground path is provided through the protruding members 457 and the contact member 400, and may be transferred to the rotatable coupling nut 200 by rotational contact between the contacting members 412 of the contact member 400 and the rotatable coupling nut 200. Pressure member 500 may be utilized to provide additional inward circumferential force to create pressure against the outer layer 1050 and translate the pressure against the braided outer conductor layer 1040 and the protruding members 457.

Referring now to FIGS. 3A-3F, various contact member configurations are schematically illustrated. The contact between the contact member, the inner sleeve, and the rotatable coupling nut provides a ground path between the braided outer conductor layer of the coaxial cable and the rotatable coupling nut. It should be understood that embodiments of the present disclosure are not limited to the example contact members 400A-400F depicted in FIGS. 3A-3F, and that other configurations are also possible.

FIG. 3A depicts an embodiment wherein the contacting members 412A extend away from a body of the contact member 400A and away from the front end 410A. The contacting members 412A (tabs in this embodiment, or in other embodiments, a single annular contacting member surface) contact an annular interior ring 270 of the rotatable coupling nut 200A and a surface of the inner sleeve 300A.

Figure 3B:
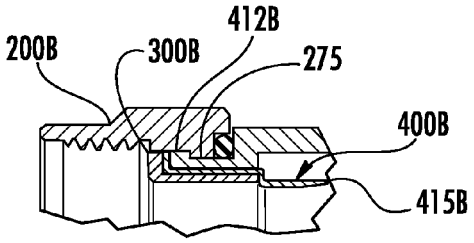

FIG. 3B depicts an embodiment wherein the contacting members 412B extend away from a body of the contact member 400B and toward the rear end 415B. The contacting members 412B (or in some embodiments, a single annular contacting member surface) contact an annular interior ring 275 of the rotatable coupling nut 200B and a surface of the inner sleeve 300B.

Figure 3C:
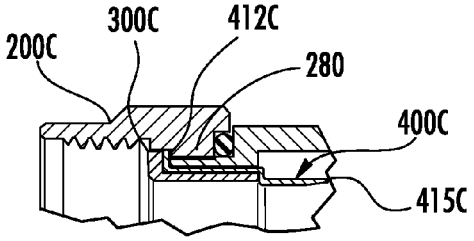

FIG. 3C depicts another embodiment wherein the contacting members 412C extend away from a body of the contact member 400C and canted toward the rear end 415C. The contacting members 412C (or in some embodiments, a single annular contacting member surface) contact an annular interior ring 280 of the rotatable coupling nut 200C and a surface of the inner sleeve 300C.

Figure 3D:
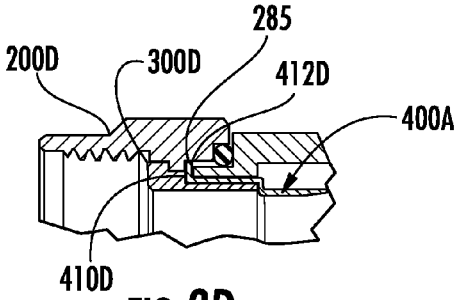

FIG. 3D depicts another embodiment wherein the contacting members 412D extend away from a body of the contact member 400D and canted away from the front end 410D. The contacting members 412D (or in some embodiments, a single annular contacting member surface) contact an annular interior ring 285 of the rotatable coupling nut 200D and a surface of the inner sleeve 300D.

Figure 3E:
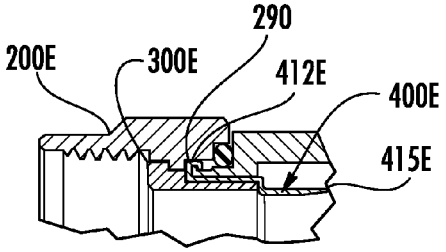

FIG. 3E depicts an embodiment wherein the contacting members 412E extend away from a body of the contact member 400E and toward the rear end 415E. The contacting members 412E (or in some embodiments, a single annular contacting member surface) contact an annular interior ring 290 of the rotatable coupling nut 200E and a surface of the inner sleeve 300E.

Figure 3F:
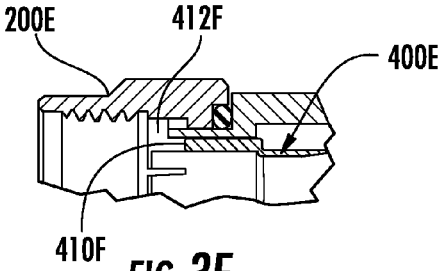

FIG. 3F depicts an embodiment with planar contacting members 412F are configured slotted segmented portion that are flared radially outwardly and contact an annular interior ring 295 of the rotatable coupling nut 200F.

Figure 4A:
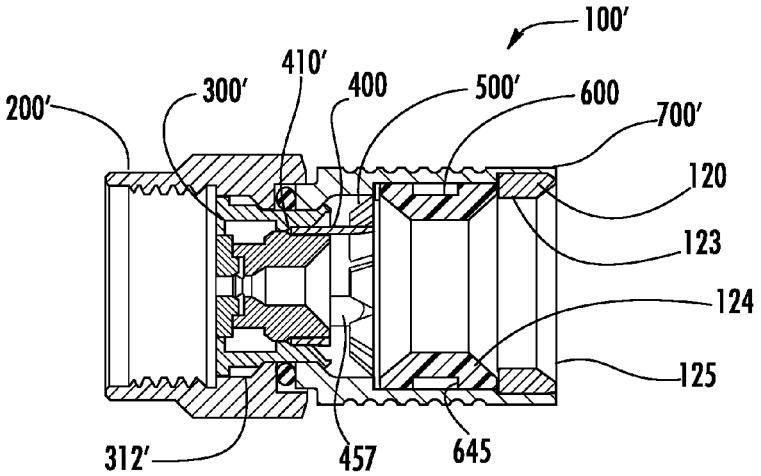
FIG. 4A schematically depicts a cross sectional view of an example coaxial cable connector providing a means for a continual ground path through an inner sleeve to a rotatable coupling nut of the coaxial cable connector according to one or more embodiments described and illustrated herein.
Figure 4B:
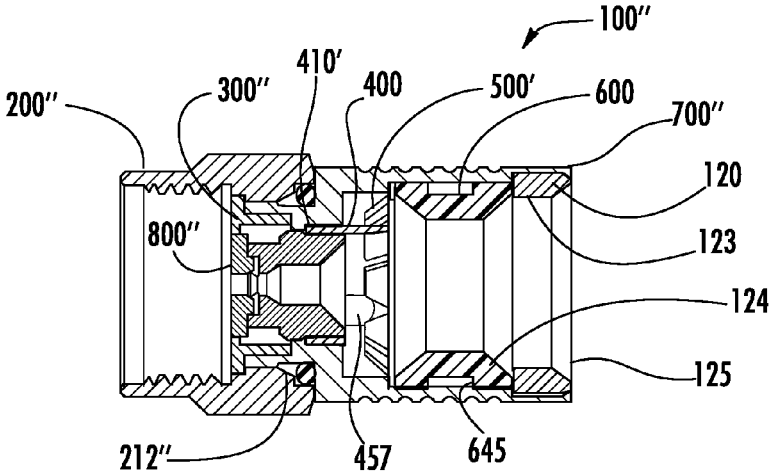
FIG. 4B schematically depicts a cross sectional view of an example coaxial cable connector providing a means for a continual ground path through a body portion to a rotatable coupling nut of the coaxial cable connector according to one or more embodiments described and illustrated herein.
Figure 4C:
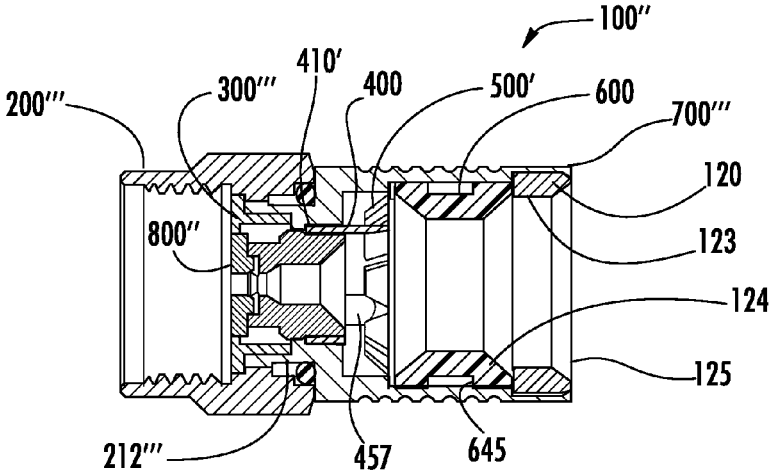
FIG. 4C schematically depicts a cross sectional view of an example coaxial cable connector providing a means for a continual ground path through a rotatable coupling nut to a body portion of the coaxial cable connector according to one or more embodiments described and illustrated herein.

FIGS. 4A-4C are cross sectional views of alternate embodiments of a coaxial cable connector providing a means for a continual ground path between the contact member and the rotatable coupling nut. In the embodiment depicted in FIG. 4A, a front end 410 portion of the contact member 400 (e.g., either individual contacting members or a continuous contacting surface) contacts a surface of the electrically conductive inner sleeve 300'. The inner sleeve 300' comprises one or more continuity features 312' that are radially flared outward and contact an inner annular ring of the rotatable coupling nut 200'. In this manner, a continual ground path is provided between the braided outer conductor layer 1040 of the coaxial cable 1000 and the rotatable coupling nut 200' through the protruding members 457, the inner sleeve 300' and the continuity feature(s) 312'.

In the embodiment depicted in FIG. 4B, a front end 410 portion of the contact member 400 (e.g., either individual contacting members or a continuous contacting surface) is disposed between the insulator member 800" and a surface of the electrically conductive body portion 700". The body portion 700" comprises one or more continuity features 712" that are radially flared outward and contact an annular ring of the rotatable coupling nut 200". In this manner, a continual ground path is provided between the braided outer conductor layer 1040 of the coaxial cable 1000 and the rotatable coupling nut 200" through the protruding members 457, the body portion 700" and the continuity feature(s) 712".

In the embodiment depicted in FIG. 4C, a front end 410 portion of the contact member 400 (e.g., either individual contacting members or a continuous contacting surface) is disposed between the insulator member 800''' and a surface of the electrically conductive body portion 700'. The rotatable coupling nut 200' comprises one or more continuity features 212''' that are radially flared inward and contact a surface of the body portion 700'''. In this manner, a continual ground path is provided between the braided outer conductor layer 1040 of the coaxial cable 1000 and the rotatable coupling nut 200' through the protruding members 457, the body portion 700''' and the continuity feature(s) 212'.

Further, FIGS. 4A-4C schematically illustrate an alternative pressure member 500' having a slotted arrangement for surrounding the outer layer 1050. The alternative pressure member 500' is an alternative to the o-ring-type pressure member 500 described above and depicted in FIG. 2A. The alternative pressure member 500' applies an inward force to the outer layer 1050 of the coaxial cable 1000 to ensure electrical contact between the braided outer conductor layer 1040 and the protruding members 457 of the contact member 400. Additionally, FIGS. 4A-4C illustrate a seal retainer 120 disposed within the body portion 700'. The seal retainer 120 has a front end 121 and a rear end 125. Extending between the front end 121 and the rear end 125 is an internal surface 123. The seal retainer 1200 further comprises a tapered membrane 124. The seal retainer 1215 may be made from plastic, such as acetal, but may be made from any appropriate material. The seal retainer 1200 may be disposed within the body portion 700' by a snap fit to both facilitate assembly of the seal 600 into and retained within the body portion 700'. The tapered membrane 124 serves to protect the tapered portion 645 of the seal 600 from accidental damage caused by the coaxial cable 1000 upon insertion and is flexible enough to allow the coaxial cable 1000 to be passed through the internal surface 123.

Figure 5A:
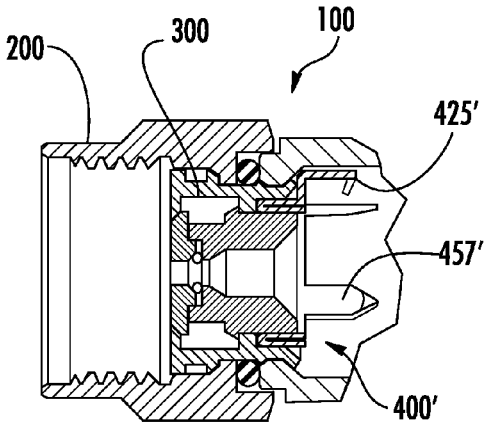
FIGS. 5A-5D schematically depict partial cross sectional views of coaxial cable connectors providing a means for compressing an outer layer of the coaxial cable against a braided outer conductor layer of the coaxial cable and a protruding member of a contact member according to one or more embodiments described and illustrated herein.
Figure 5C:
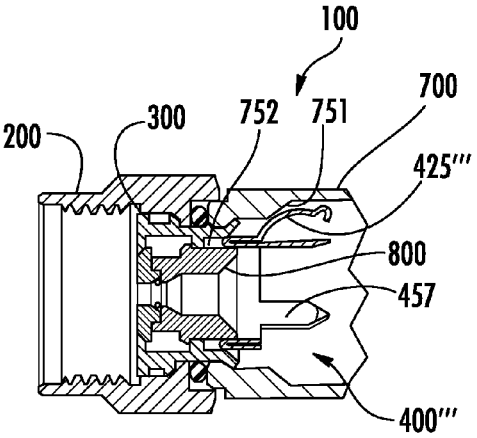
Figure 5D:
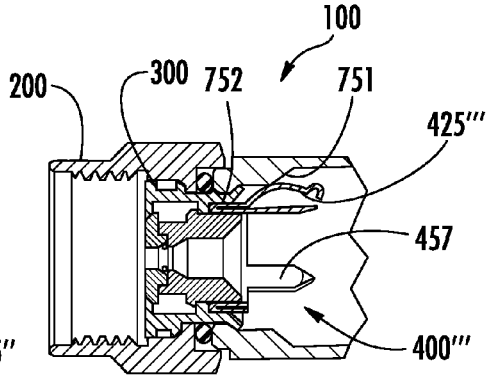
Figure 5B:
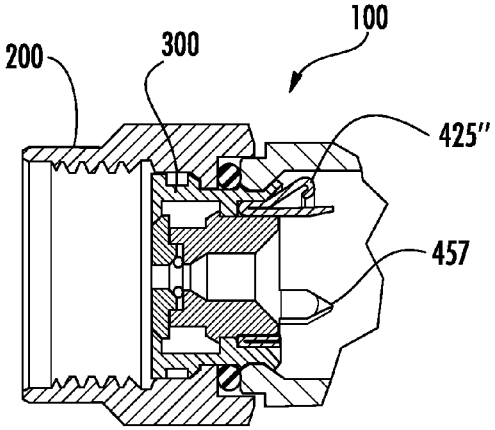

FIGS. 5A-5D are partial cross sectional views of embodiments of a coaxial cable connector 100 that provide a means for compressing the outer layer 1050 of the coaxial cable 1000 against the braided outer conductor layer 1040 and the protruding members 457' of the contact member 400'. More specifically, FIGS. 5A and 5B illustrate contact member 400' having integral outer fingers 425', 425" to serve in the place of, or in addition to, the pressure member 500 illustrated in FIG. 2A. The integral outer fingers 425', 425" apply inward pressure on the outer layer 1050 of the coaxial cable 1000. The integral outer fingers 425', 425" of FIGS. 5A and 5B, respectively, are shown in two different geometric configurations illustrating that there are a number of possible shapes that may be employed.

Figure 5E:
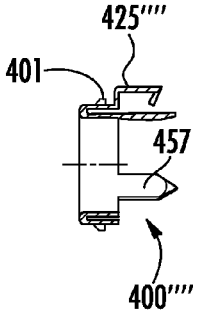
FIG. 5E schematically depicts a cross sectional view of a contact member having an optional snap-in feature according to one or more embodiments described and illustrated herein.

FIGS. 5C and 5D depict a slidable contact member 400" wherein a portion of the slidable contact member 400" is disposed within a channel 752 defined by the insulator member 800 and the inner sleeve 300. A ramp 751 is provided in an inner surface of the body portion 700. The integral outer fingers 425''' of the slidable contact member 400' are in an open position when slidable contact member 400''' is a rearward position (FIG. 5C). When the slidable contact member 400' is moved to a forward position within the channel 752 by insertion of the coaxial cable 1000, the ramp 751 causes the outer fingers 751''' to be radially compressed against the outer layer 1050 of the coaxial cable, thereby applying pressure thereto (FIG. 5D). FIG. 5E depicts a slidable contact member 400'''' as shown in FIGS. 5C and 5D and further comprising snap-in lugs 401 suitable for retention within the inner sleeve 300.

Figure 5F:
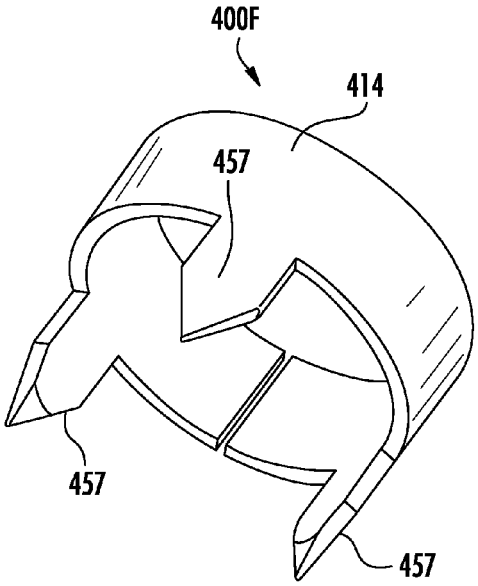
FIGS. 5F-5H schematically depict perspective views of alternate contact members according to one or more embodiments described and illustrated herein.
Figure 5G:
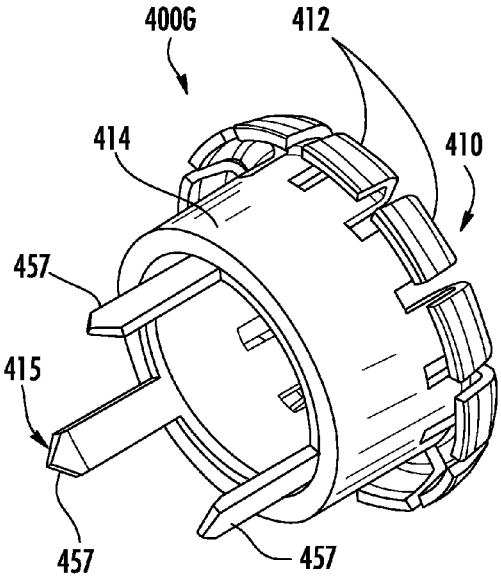
Figure 5H:
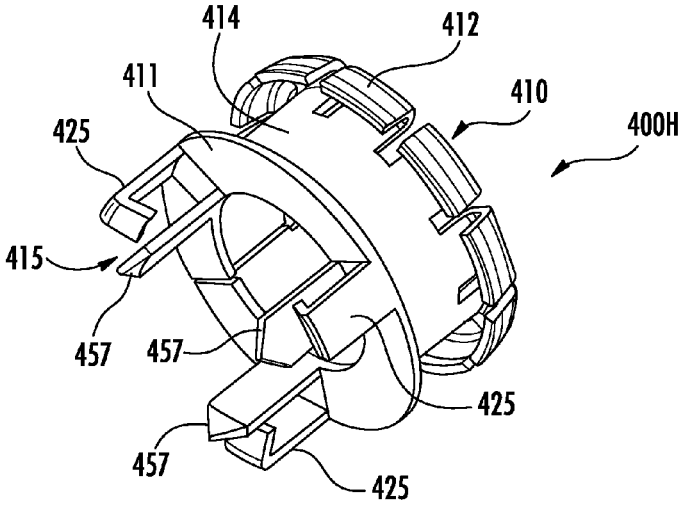

FIGS. 5F-5H are perspective views of alternate embodiments of contact members 400E-400H provided for illustrative purposes. FIG. 5F illustrates a contact member 400F having a body 414 without contacting members, and three protruding members 457. FIG. 5G illustrates a contact member 400G having a body 414 and a plurality of contacting members 412 extending from the body 414 at the front end 410 and three protruding members 457 extending from an inner circumference of the body 414 at the rear end 415. FIG. 5H illustrates a contact member 400H having a plurality of contacting members 412 extending from the body 414 at the front end 410 and three protruding members 457 extending from an inner circumference of the body 414 at the rear end 415. The example contact member 400H further includes a compression flange 411 from which three outer fingers 425 extend. The three outer fingers 425 are radially aligned with the three protruding members 457 in the illustrated example.

Figure 6A:
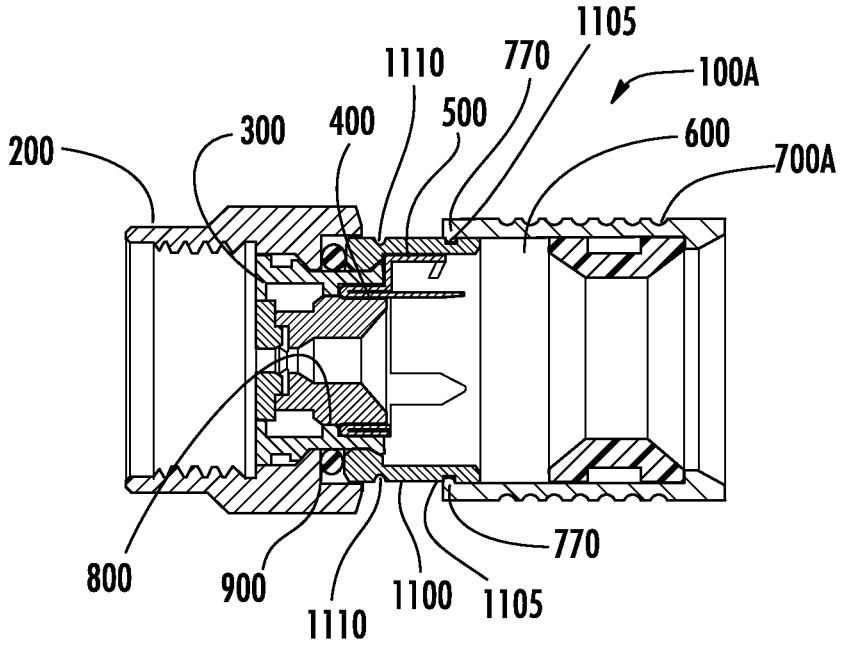
FIG. 6A schematically depicts a cross sectional view of an example coaxial cable connector having a moveable body portion in an open or uncompressed position according to one or more embodiments described and illustrated herein.
Figure 6B:
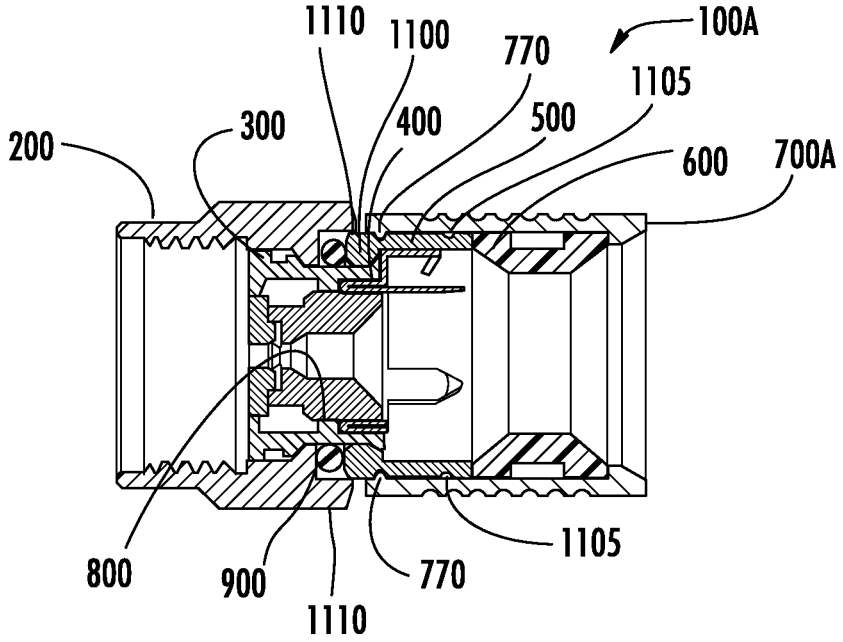
FIG. 6B schematically depicts a cross sectional view the coaxial cable connector of FIG. 6A in a closed or compressed position according to one or more embodiments described and illustrated herein.

FIGS. 6A and 6B depict an embodiment wherein the connector 100A comprises a body coupling member 1100 partially disposed between the inner sleeve 300 and the rotatable coupling nut 200. The body coupling member 1100 comprises a plurality of forward notches 1110 and a plurality of rear notches 1105. The connector 100A comprises a slidable body portion 700A having a plurality of detents 770. The detents 770 are disposed in the plurality of rear notches 1105 when the connector 100A is in an uncompressed or open position. Using a tool, the connector 100A may be closed by sliding the slidable body portion 700A forward such that the detents 770 are disposed in the plurality of forward notches 1110.

Figure 7A:
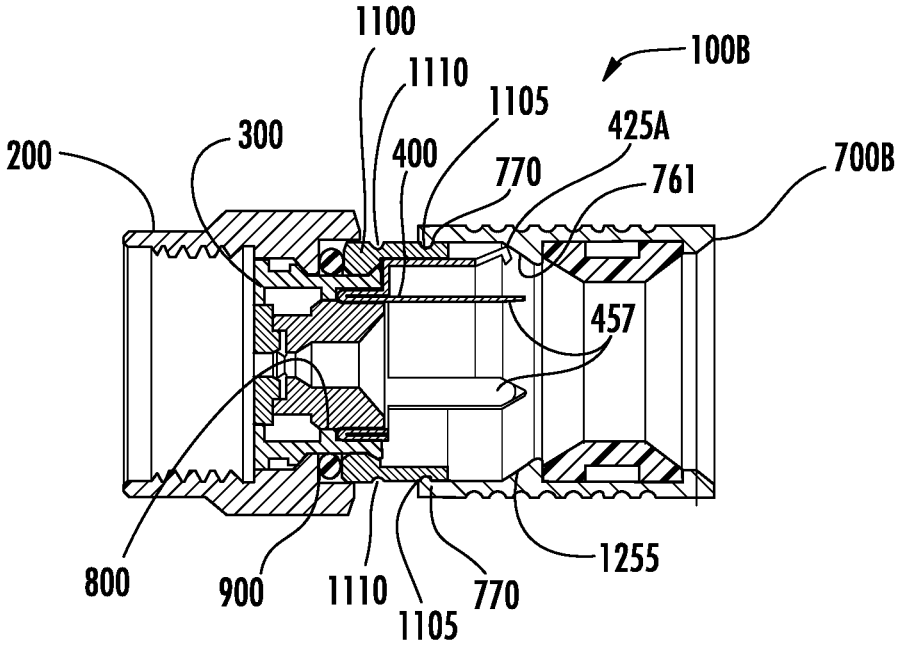
FIG. 7A schematically depicts a cross sectional view of a coaxial cable connector having a moveable body portion capable of displacing a cable jacket compressive portion in an open or uncompressed position according to one or more embodiments described and illustrated herein.
Figure 7B:
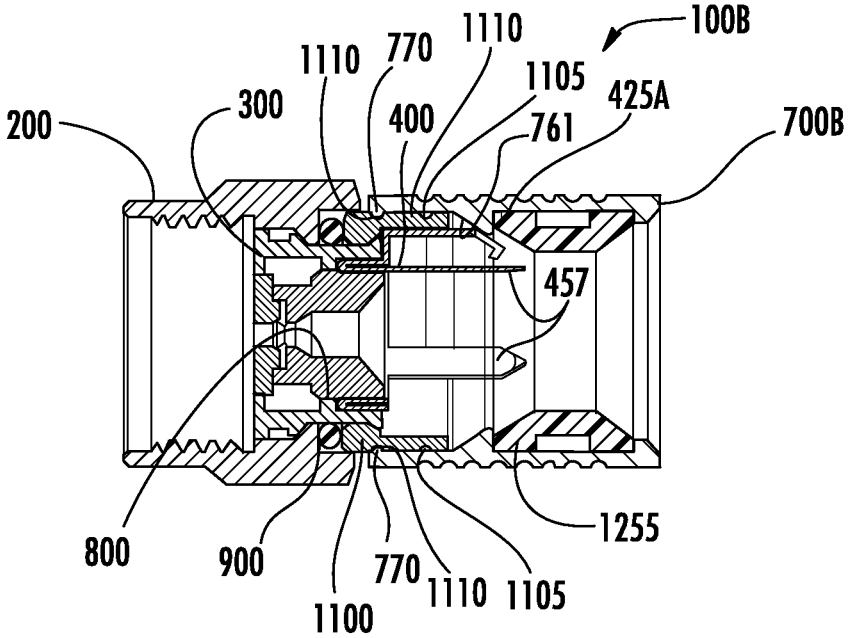
FIG. 7B schematically depicts a cross sectional view of the coaxial cable connector of FIG. 7A in a closed or compressed position according to one or more embodiments described and illustrated herein.

FIGS. 7A and 7B depict a connector 100B similar to the connector 100A illustrated in FIGS. 6A and 6B, except that the slidable body portion 700B includes an tapered portion 761 configured to press the plurality of outer fingers 425A toward the plurality of protruding members 457 when the slidable body portion 700B is transitioned from an open position (FIG. 7A) to a closed position (FIG. 7B).

Various non-limiting configurations of the conductor retaining member will now be described. FIGS. 8A-8F and 8A'-8F' schematically illustrate views of non-limiting conductor retaining members 900. FIGS. 8A-8F depict a front view of the example conductor retaining members 900, while FIGS. 8A'-8F' depict corresponding side view of the conductor retaining members 900 depicted in FIGS. 8A-8F. The example conductor retaining members 900 have a disk-like configuration. In general, each of the example conductor retaining members 900 has a perimeter surface 905, a front surface 910 and a rear surface 915. Extending between the front surface 910 and the rear surface 915 is a central aperture sized to receive the inner conductor 1010 and a plurality of radial slots 935 that define a plurality of protrusions 940.

Figure 8A:
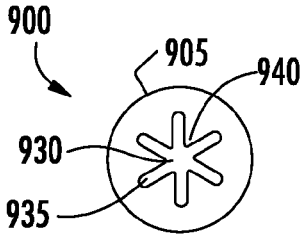
FIGS. 8A-8F schematically depict front views of a plurality of alternative conductor retaining members according embodiments described and illustrated herein.
Figure 8A:
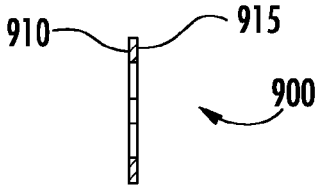
Figure 8B:
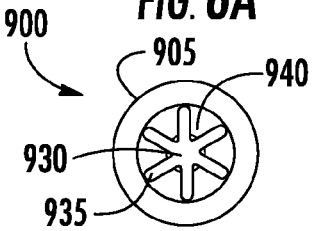
Figure 8B:
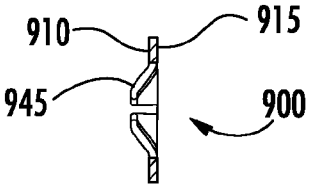
Figure 8C:
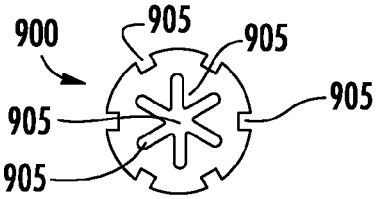
Figure 8C:
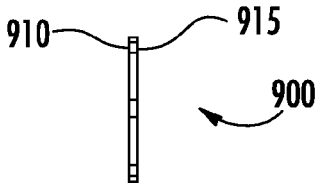
Figure 8D:
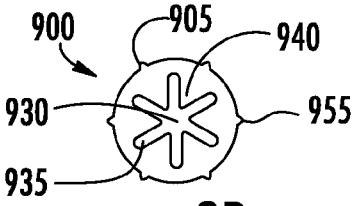
Figure 8D:
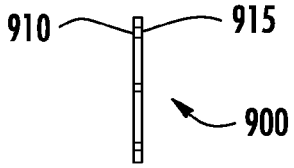
Figure 8E:
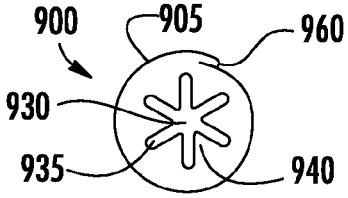
Figure 8E:
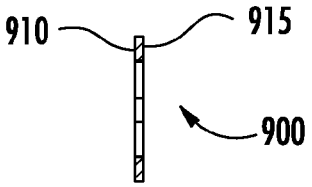
Figure 8F:
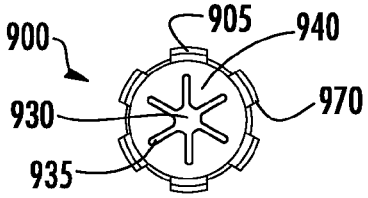
Figure 8F:
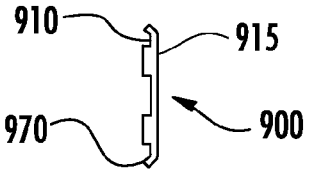

The example conductor retaining member 900 of FIGS. 8B and 8B' comprises canted portion 945 providing mechanical reinforcement against inner conductor 1010 withdrawal. FIGS. 8C and 8C' additionally include external slots 950 at the perimeter surface 905 to provide resistance against rotational movement within the insulator member. The conductor retaining member 900 of FIGS. 8D and 8D' comprises one or more engagement features, such as external protrusions 955, at the perimeter surface 905 to provide resistance against rotational movement within the insulator member. The conductor retaining member 900 of FIGS. 8E and 8E' comprises a slitted finger 960 at the perimeter surface 905 to provide resistance against rotational movement within the insulated member in the manner of a stamped thread configuration. The conductor retaining member 900 of FIGS. 8F and 8F' comprises canted external protrusions 970 at the perimeter surface 905 to provide resistance against rotational movement within the insulator member and mechanical reinforcement against flexing. It should be understood that the variations depicted in FIGS. 8A-8F and 8A'-8F' are for illustrative purposes, and that any combination of the illustrated features as well as those not illustrated may be utilized.

Figure 9A:
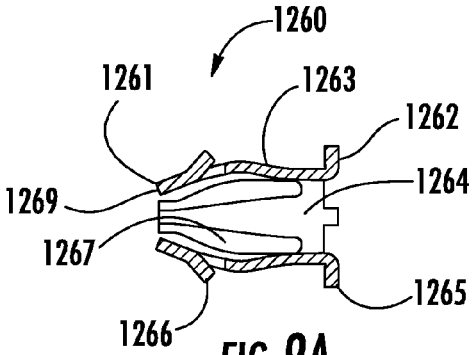
FIG. 9A schematically depicts a cross sectional view of a conductor retaining member having a tube-like or cylindrical configuration according to one or more embodiments described and illustrated herein.

FIG. 9A schematically illustrates in cross section an alternative conductor retaining member 1260 to the conductor retaining members 900 depicted in FIGS. 8A-8F and 8A'-8F'. The example conductor retaining member 1260 illustrated in FIG. 9A has a tube-like or cylindrical configuration. The conductor retaining member 1260 has a front end 1261 and a rear end 1262. Extending between the front end 1261 and the rear end 1262 is an aperture 1264. The conductor retaining member 1260 further comprises an outer surface 1263, a plurality of end tangs 1265, a plurality of radial tangs 1266, a plurality of slots 1267, and interior edge 1269.

Figure 9B:
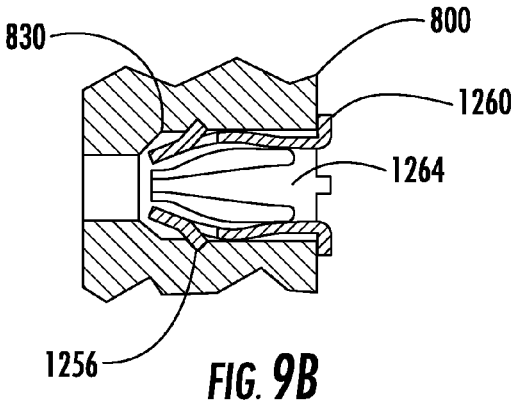
FIG. 9B schematically depicts a cross sectional view of the conductor retaining member of FIG. 9A installed in an insulator member according to one or more embodiments described and illustrated herein.

FIG. 9B is a cross sectional view of the conductor retaining member 1260 inserted into an internal surface 830 of the insulator member 800. The depth of insertion of conductor retaining member 1260 into the internal surface 830 of the insulator member 800 is limited by the end tangs 1265. The plurality of radial tangs 1266 embed into the internal surface 830 of insulator member 800, thereby preventing extraction of conductor retaining member 1260 from the internal surface.

Figure 9C:
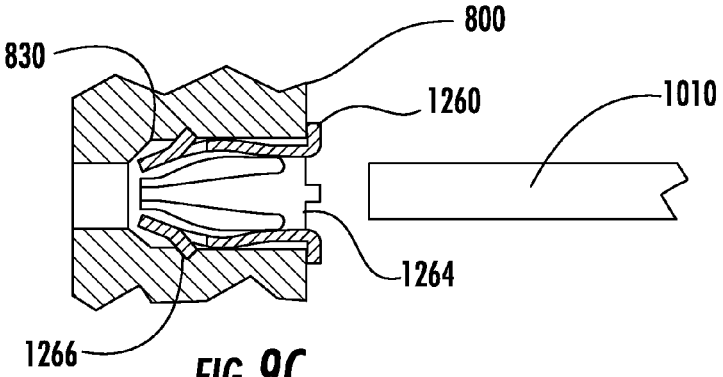
FIG. 9C schematically depicts a cross sectional view of the conductor retaining member of FIGS. 9A and 9B installed in an insulator member and having an inner conductor of a coaxial cable introduced according to one or more embodiments described and illustrated herein.
Figure 9D:
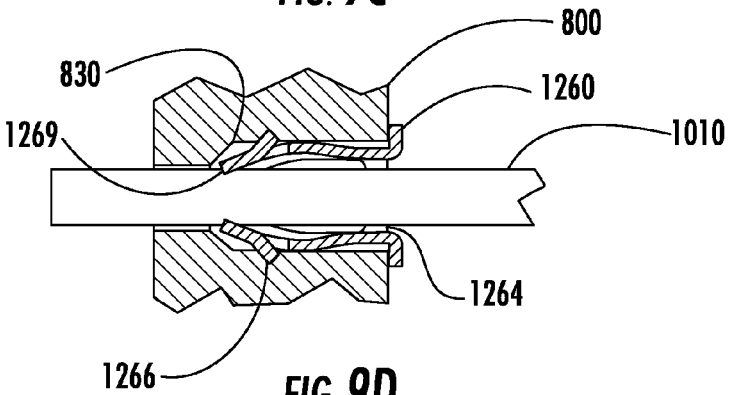
FIG. 9D schematically depicts a cross sectional view of the conductor retaining member installed in the insulator member as illustrated in FIGS. 9B and 9C with the inner conductor fully inserted into the conductor retaining member according to one or more embodiments described and illustrated herein.

FIG. 9C is a partial cross sectional view of the insulator member 800 and the conductor retaining member 1260 as depicted in FIG. 9C with an inner conductor 1010 of a coaxial cable prior to insertion into the conductor retaining member 1260. FIG. 9D is a partial cross sectional view wherein the inner conductor 1010 is inserted into the aperture 1264 of the conductor retaining member 1260. The inner conductor 1010 radially expands the conductor retaining member 1260, thereby causing the plurality of radial tangs 1266 to further embed into the internal surface 830 of the insulator member 800. The interior edge 1269 of the radial tangs 1266 enter into the surface of the inner conductor 1010, thereby preventing the inner conductor 1010 from being moved axially rearward.

Figure 10A:
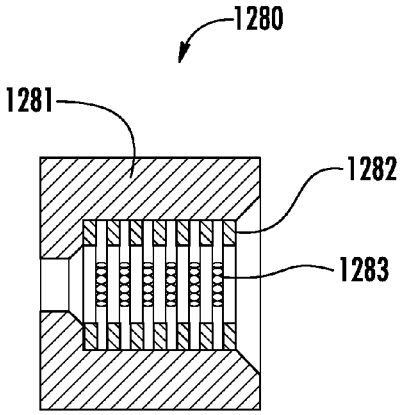
FIG. 10A schematically depicts a cross sectional view of a conductor retaining member having a bristle-element configuration according to one or more embodiments described and illustrated herein.
Figure 10B:
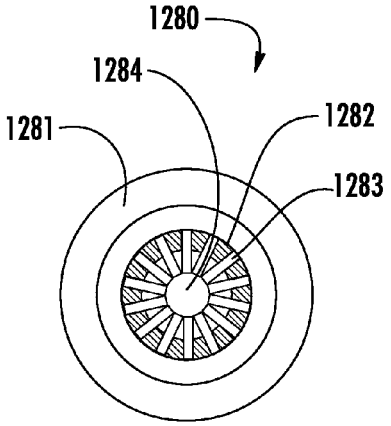
FIG. 10B schematically depicts an end view of the conductor retaining member depicted in FIG. 10A.

Referring now to FIGS. 10A-10D, another alternative conductor retaining member 1280 is schematically illustrated. FIG. 10A depicts the conductor retaining member 1280 in cross section, while FIG. 10B is a schematic end view of the conductor retaining member 1280 depicted in FIG. 10A. The conductor retaining member 1280 has a bristle-type configuration. The conductor retaining member 1280 comprises an insulative portion 1281 that maintains retaining segments 1282 which fixture a plurality of radial bristle elements 1283. The plurality of bristle elements 1283 are arranged such that they form an aperture 1284. The insulative portion 1281 may be injection molded from a plastic material such as acetal or the like, for example. Retaining segments 1282 may likewise be constructed from a plastic material. The bristle elements 1283 may be made from a material such as a fine wire.

Figure 10D:
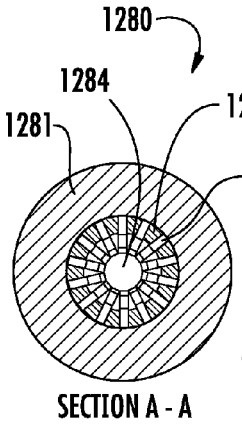
FIG. 10D schematically depicts a partial cross sectional view of the conductor retaining member of FIGS. 10A-10C having a cable center conductor inserted therein according to one or more embodiments described and illustrated herein.
Figure 10C:
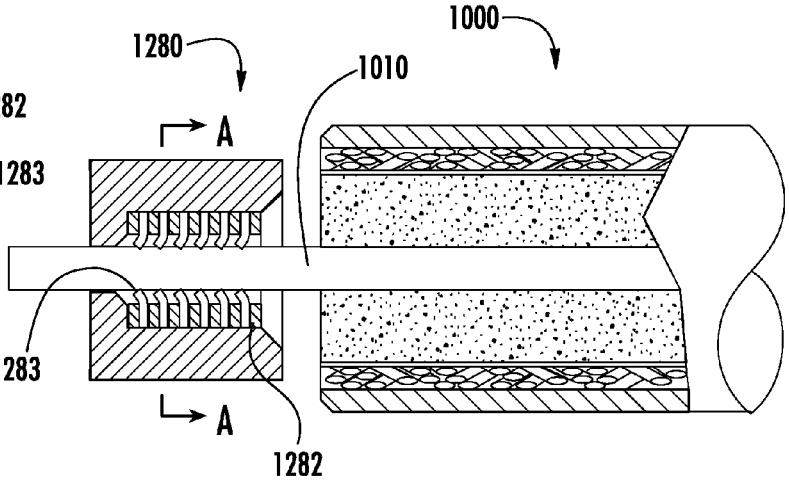
FIG. 10C schematically depicts a cross sectional view of the conductor retaining member depicted in FIGS. 10A and 10B having a cable center conductor inserted therein according to one or more embodiments described and illustrated herein.

FIG. 10C is a cross sectional illustration of the conductor retaining member 1280 depicted in FIGS. 10A and 10B with an inner conductor 1010 of a coaxial cable 1000 inserted therein. Insertion of the inner conductor 1010 into conductor retaining member 1280 causes the bristle elements 1283 to flex axially forward. Force applied to the coaxial cable 1000 to withdraw the inner conductor 1010 causes bristle elements 1283 to try to return to their original position. However, the diameter of the inner conductor 1010 prevents the aperture 1284 from returning to its original dimension, thereby forcing the bristle elements 1283 to be embedded into the surface of the inner conductor 1010. In this manner, the inner conductor 1010 is prevented from being removed from the conductor retaining member 1280. FIG. 10D is a cross sectional illustration of the conductor retaining member 1280 and coaxial cable 1000 of FIG. 10C taken along section line 10D-10D.

Figure 11A:
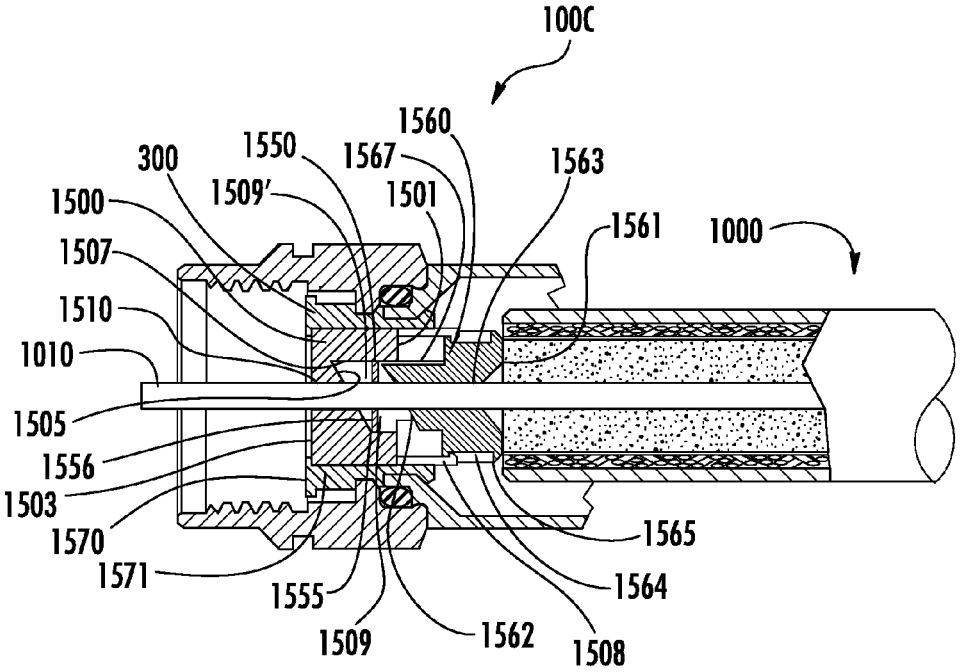
FIG. 11A schematically depicts a partial cross sectional view of a connector including a conductor retaining member and a first and second insulator members, wherein the first and second insulators are in an open position according to one or more embodiments described and illustrated herein.
Figure 11B:
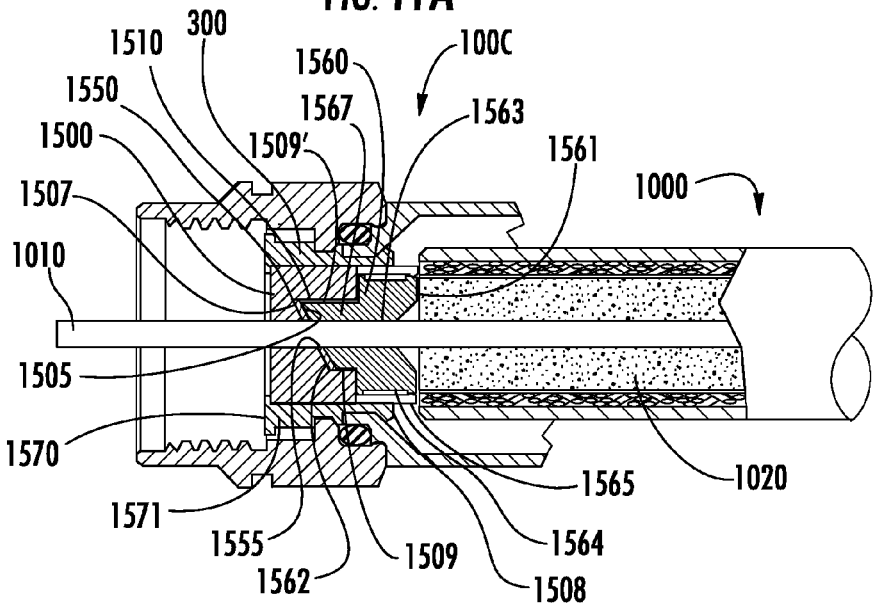
FIG. 11B schematically depicts a partial cross sectional view of the connector depicted in FIG. 11A, wherein the first and second insulators are in a closed position according to one or more embodiments described and illustrated herein.

FIGS. 11A and 11B illustrate a connector 100C having an alternative conductor retaining means. Referring to FIG. 11A, the connector 100C comprises a first insulator member 1500, a conductor retaining member 1550, and a second insulator member 1560. The first insulator member 1500 partially comprises a first coupling surface 1505, a first internal bore 1507, a plurality of fingers 1508, bumps 1509 and 1509', and a second internal bore 1510. The first insulator member 1500 is preferably made from an insulative material such as plastic and, as a non-limiting example, from acetal. The first internal bore 1507 extends from an insertion end 1501 of the first insulator member 1500 to the first coupling surface 1505. The first coupling surface 1505 is non-orthogonally transverse to a central axis of the first internal bore 1507 (i.e., it is sloped). The second internal bore 1510 extends from the first coupling surface 1505 to an exit surface 1503 of the first insulator member 1500. The outer surface of the first insulator member 1500 is at least partially disposed within the inner sleeve 300.

The second insulator member 1560 partially comprises a base portion 1561, a protruding portion 1567, a second coupling surface 1562, a third internal bore 1563 through the base portion 1561 and the protruding portion 1567, a plurality of slots 1564, and a plurality of ridges 1565. The second insulator member 1560 may be made from an insulative material, such as plastic (e.g., acetal). The plurality of slots 1564 may include one or more inner circumferential slots 1564. The protruding portion 1567 of the second insulator member 1560 is slidably disposed within the first internal bore 1507 of the first insulator member 1570. The second coupling surface 1562 is non-orthogonally transverse to the central axis of the first internal bore 1507.

The conductor retaining member 1550 comprises a central aperture 1555 and a face 1556. The conductor retaining member 1550, which may be configured as a circular disc, may be made from brass or other suitable material. The conductor retaining member 1550 is disposed within the first internal bore 1507 between the first coupling surface 1505 and the second coupling surface 1562 such that it is substantially orthogonal with respect to the central axis of the first internal bore 1507.

In FIG. 11A, a coaxial cable 1000 is partially inserted through the third internal bore 1563, the central aperture 1555 and the second internal bore 1510. The starting position of the conductor retaining member 1550 is maintained by bumps 1509 and 1509' which hold the face 1556 of conductor retaining member 1550 orthogonal to the central axis of the first internal bore 1507.

FIG. 11B is a cross sectional schematic illustration of the connector 110C shown in FIG. 11A wherein coaxial cable 1000 has been further advanced into the connector 100C. The insulator layer 1020 of the coaxial cable 1000 is forced against the base portion 1561 of second insulator member 1560, thereby driving the second insulator member 1560 into the conductor retaining member 1550. The sloped second coupling surface 1562 of the second insulator member 1560 causes the conductor retaining member 1550 to tilt off-axis and be driven past bump 1509' and against the sloped first coupling surface 1505 of the first insulator member 1500. The slots 1564 of the second insulator member 1560 slide in relation to the fingers 1508 of the first insulator member 1500 to maintain alignment of the components. The ridges 1565 engage the fingers 1508 by means of a snap fit, thereby retaining the second insulator 5160 at least partially within the first insulator member 1500. The tilting of the conductor retaining member 1550 causes the central aperture 1555 to engage the inner conductor 1010 of the coaxial cable 1000, thereby capturing coaxial cable 1000 within the connector 100C.

Figure 12A:
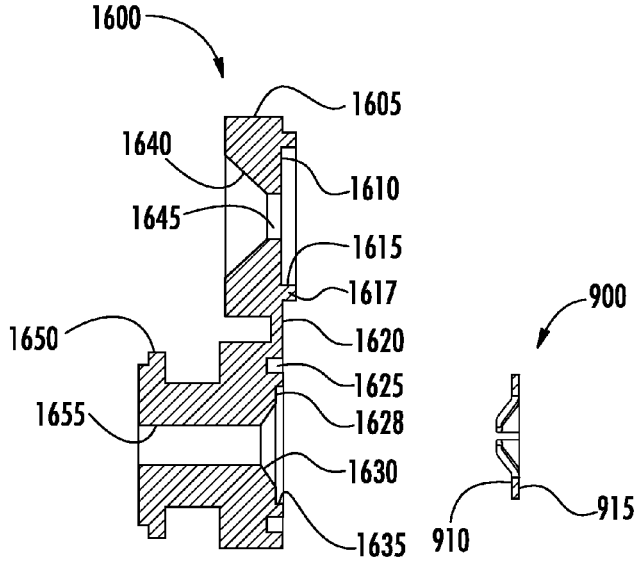
FIG. 12A schematically depicts a cross sectional view of an insulator member configured to encapsulate a conductor retaining member as depicted in FIGS. 8A-8F, wherein the insulator member is in an open position according to one or more embodiments described and illustrated herein.
Figure 12B:
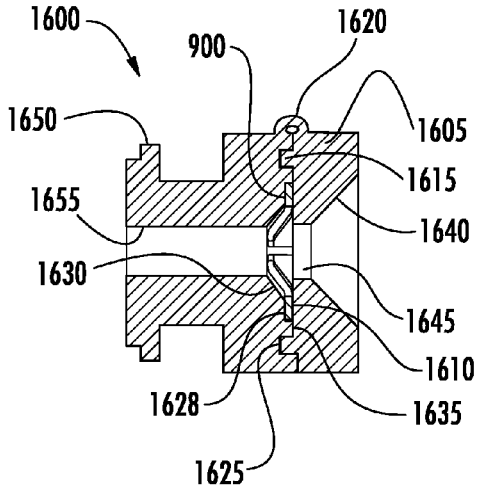
FIG. 12B schematically depicts a cross sectional view of the insulator member depicted in FIG. 12A in a closed position according to one or more embodiments described and illustrated herein.

Alternative insulator members and means of the capturing conductor retaining member 900 will now be described with reference to FIGS. 12A-12F. FIG. 12A is a cross sectional view of an insulator member 1600 which comprises a cap 1605, counter bore 1615, an annular lip 1617, a hinge 1620, a trepan 1625, a face 1628, a taper 1630, counter bore 1635, a main portion 1650, and a bore 1655. The insulator member 1600 is made from an insulative material (e.g., acetal). A representative embodiment of a conductor retaining member 900 is shown in preparation for installation into the insulator member 1600. In FIG. 12B, the conductor retaining member 900 is inserted into counter bore 1635 with the front surface 910 positioned against the face 1628 of the insulator member 1600. The cap 1605 is then closed by means of the hinge 1620 bringing the face 1610 against the rear surface 915 of the conductor retaining member 900 and engaging the annular lip 1617 with the trepan 1625, thereby fully encapsulating the conductor retaining member 900 within the insulator member 1600. The entire sub-assembly may now be assembled with the remaining connector components.

Figure 12C:
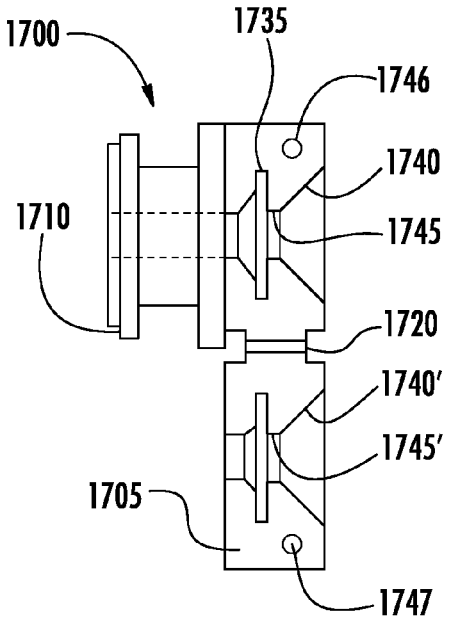
FIG. 12C schematically depicts a cross sectional view of another insulator member configured to encapsulate a conductor retaining member as depicted in FIGS. 8A-8F, wherein the insulator member is in an open position according to one or more embodiments described and illustrated herein.
Figure 12D:
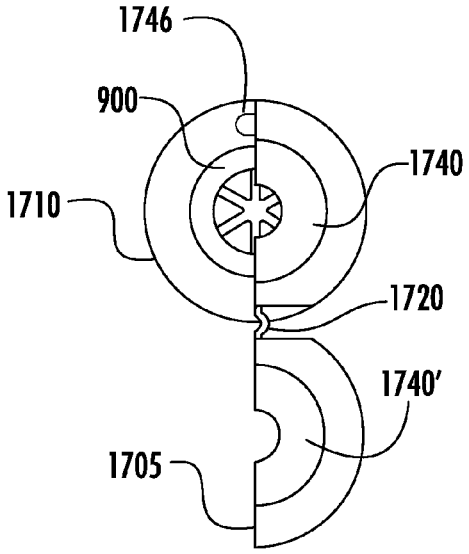
FIG. 12D schematically depicts an end view of the insulator member depicted in FIG. 12C, wherein the insulator member is in an open position according to one or more embodiments described and illustrated herein.
Figure 12E:
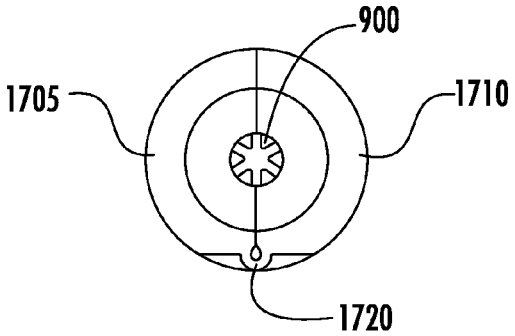
FIG. 12E schematically depicts an end view of the insulator member depicted in FIGS. 12C and 12D, wherein the insulator member is in a closed position.

FIG. 12C is a schematic view of an alternate embodiment of an insulator member 1700 which comprises a cap 1705, a main portion 1710, a hinge 1720, a recess 1735, a bore 1745, a pin 1746, and a hole 1747. The insulator member 1700 is made from an insulative material (e.g., acetal). FIG. 12D illustrates the insulator member 1700 of FIG. 12C in a schematic end view wherein a representative version of a conductor retaining member 900 is shown at least partially inserted into the recess 1735 of the insulator member 1700. As seen in FIG. 12E, the cap 1705 is then closed by way of the hinge 1720, thereby fully encapsulating the conductor retaining member 900 within the insulator member 1700. The entire sub-assembly may now be assembled with the remaining connector components.

Figure 12F:
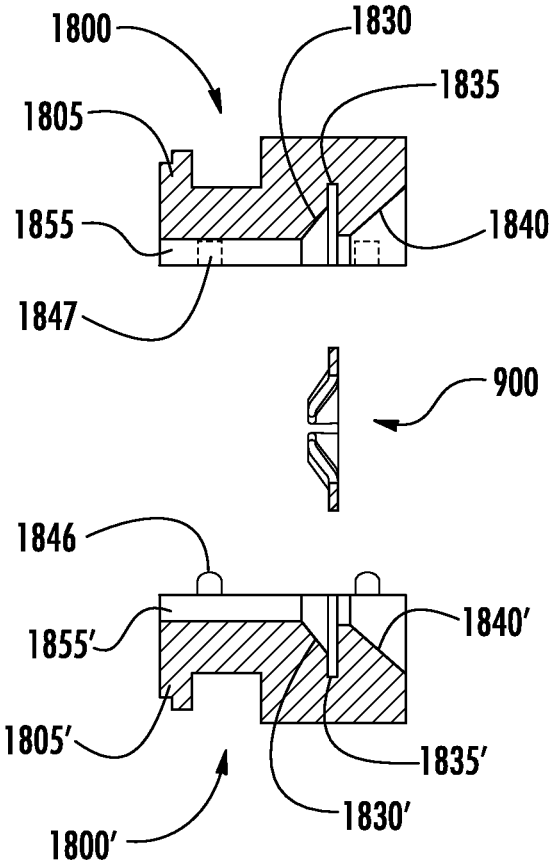
FIG. 12F schematically depicts an exploded cross sectional view of an insulator member configured to encapsulate a conductor retaining member as illustrated in FIGS. 8A-8F wherein the insulator member has a two-part configuration in an un-assembled state.

FIG. 12F is a cross sectional view of an insulator member 1800 which is at least partially comprised of two insulator halves 1805 and 1805', recesses 1835 and 1835, a plurality of holes 1847, and a plurality of pins 1846. The insulator member 1800 is preferably made from an insulative material such (e.g., acetal). A representative embodiment of a conductor retaining member 900 is shown in preparation for installation into the example insulator member 1800. The conductor retaining member 900 is inserted into the recess 1835. Half 1805 is then mated with half 1805' guided by a plurality of holes 1847, and a plurality of pins 1846 thus fully encapsulating conductor retaining member 900 within insulator halves 1805 and 1805'. Bore halves 1855 and 1855' mate to form an internal bore. The entire sub-assembly may now be assembled with the remaining connector components.

The conductor retention means (e.g., provided by the conductor retaining members described herein) and ground path means (e.g., provided by the contact members described herein) may be incorporated into any style of coaxial connector. For example, the conductor retaining members and contact members described herein may be incorporated into coaxial connectors sold by Corning Gilbert, Inc., such as those described in U.S. Pat. Nos. 5,975,951, 5,997,350, 7,018,235, 7,182,639 and 7,331,820.

For the purposes of describing and defining the subject matter of the disclosure it is noted that the term "substantially" is utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A connector for connecting to a co-axial cable, the connector comprising:

a body portion comprising a first end and a second end, the body portion defining a bore;

a contact member comprising a circumferential portion and a plurality of protruding members, wherein:

the contact member is electrically conductive;

an outer surface of the circumferential portion is at least partially disposed within the bore at the first end of the body portion; and the plurality of protruding members each protrude from the circumferential portion toward the second end of the body portion and within the bore;

an inner sleeve at least partially disposed within the circumferential portion of the contact member;

a rotatable coupling nut rotatably coupled to the inner sleeve, wherein the rotatable coupling nut is electrically conductive and is electrically coupled to the contact member; and a conductor retaining member centrally disposed within the inner sleeve, the conductor retaining member configured to receive an inner conductor of the co-axial cable such that the inner conductor is free to pass through the conductor retaining member in a first direction toward the first end of the body portion, and is restricted from passing through the conductor retaining member in a second direction away from the rotatable coupling nut.

2. The connector of claim 1, wherein the first end of the body portion, the contact member, and the inner sleeve are coupled together by a press fit.

3. The connector of claim 1, wherein the conductor retaining member comprises a central aperture having a diameter configured to receive the inner conductor of the co-axial cable, and a plurality of radial openings that define a plurality of flexible protrusions that allows movement of the inner conductor of the co-axial cable in the first direction and prevents movement of the inner conductor in the second direction.

4. The connector of claim 1, wherein the conductor retaining member comprises a plurality of radial bristle elements that define a central aperture, wherein the plurality of radial bristle elements allow movement of the inner conductor of the co-axial cable in the first direction and prevents movement of the inner conductor in the second direction.

5. The connector of claim 1, further comprising an insulator member comprising an outer surface and an internal bore, wherein:

at least a portion of the outer surface contacts an inner surface of the inner sleeve; and the conductor retaining member is disposed within the internal bore of the insulator member.

6. The connector of claim 5, wherein the internal bore comprises a tapered conductor guide portion.

7. The connector of claim 5, wherein the internal bore of the insulator member comprises an inner circumferential slot, and at least a portion of the conductor retaining member is disposed within the inner circumferential slot.

8. The connector of claim 7, wherein the conductor retaining member further comprises one or more engagement features configured to prevent rotational movement of the conductor retaining member within the slot.

9. The connector of claim 8, wherein the one or more engagement features comprises at least one notch.

10. The connector of claim 5, wherein the conductor retaining member comprises a central aperture having a diameter configured to receive the inner conductor of the co-axial cable, and a plurality of radial openings that define a plurality of flexible protrusions that allows movement of the inner conductor of the co-axial cable in the first direction and prevents movement of the inner conductor in the second direction.

11. The connector of claim 5, wherein:

the conductor retaining member is at least partially disposed within the internal bore the conductor retaining member comprises a plurality of end tangs that contact an internal surface of the insulator member, a plurality of radial tangs embedded in a surface of the internal bore, and a plurality of slots extending along a length of the conductor retaining member.

12. The connector of claim 11, wherein the plurality of radial tangs is configured to move outwardly upon insertion of the inner conductor of the co-axial cable such that an end of each radial tang engages the inner conductor to prevent movement of the inner conductor in the second direction.

13. The connector of claim 1, further comprising:

a first insulator member comprising an outer surface, a first internal bore and a second internal bore, wherein:

the first internal bore extends from an insertion end of the first insulator member to a first coupling surface that is non-orthogonally transverse to a central axis of the first internal bore;

the second internal bore extends from the first coupling surface to an exit surface of the first insulator member; and the outer surface of the first insulator member is at least partially disposed within the inner sleeve;

a second insulator member comprising a protruding portion having a second coupling surface, a base portion, and a third internal bore within the protruding portion and the base portion, wherein:

the protruding portion of the second insulator member is slidably disposed within the first internal bore of the first insulator member; and the second coupling surface is non-orthogonally transverse to the central axis of the first internal bore;

the second coupling surface of the second insulator member is offset from the first coupling surface of the first insulator member;

wherein:

the conductor retaining member comprises a central aperture;

the conductor retaining member is disposed within the first internal bore between the first coupling surface and the second coupling surface such that it is substantially orthogonal with respect to the central axis of the first internal bore; and when the inner conductor is inserted into the central aperture and the first internal bore of the first insulator member, the co-axial cable translates the second insulator member such that the conductor retaining member becomes non-orthogonally transverse to the first internal bore of the first insulator member and contacts both the first coupling surface and the second coupling surface.

14. The connector of claim 1, wherein the plurality of protruding members are configured to contact an outer conductor layer of the co-axial cable is inserted into the connector.

15. The connector of claim 1, wherein the plurality of protruding members comprise a plurality of protruding members protruding from a circumference of the circumferential portion.

16. The connector of claim 1, further comprising a compression member disposed within an inner surface of the bore defined by the body portion, wherein the compression member provides an inward force on an outer surface of the co-axial cable when the co-axial cable is fully positioned within the connector.

17. The connector of claim 16, wherein the compression member comprises a pliable o-ring.

18. The connector of claim 1, wherein:

the plurality of protruding members comprise a plurality of protruding members protruding the circumferential portion, the plurality of protruding members defining a first diameter;

the contact member comprises a plurality of compression flanges protruding from the circumferential portion;

the plurality of compression flanges is radially aligned with the plurality of protruding members and defines a second diameter that is greater than the first diameter; and the plurality of compression flanges provides an inward force on an outer surface of the co-axial cable when the co-axial cable is fully positioned within the connector.

19. The connector of claim 1, wherein:

the circumferential portion of the contact member comprises a first end and a second end;

the plurality of protruding members each protrude from the first end of the circumferential portion;

the contact member further comprises a plurality of contacting tabs extending from the second end of the circumferential portion; and the plurality of contacting tabs contact an interior surface of the rotatable coupling nut to electrically couple the at least one protruding portion of the contact member to the rotatable coupling nut.

20. The connector of claim 19, wherein each contacting tab of the plurality of contacting tabs curves away from an outer surface of the circumferential portion and toward the first end of the circumferential portion.

21. A co-axial cable assembly comprising:

a co-axial cable comprising:

an inner conductor positioned on an axis of the co-axial cable;

an insulator layer surrounding the inner conductor;

a braided outer conductor layer surrounding the insulator layer; and an outer layer surrounding the braided outer conductor layer, wherein an end portion of the inner conductor is exposed beyond the insulator layer, the braided outer conductor layer, and the outer layer; and at least one connector coupled to an end of the co-axial cable, the at least one connector comprising:

a body portion comprising a first end and a second end, the body portion defining a bore, wherein a portion of the inner conductor, the insulator layer, the braided outer conductor layer, and the outer layer is disposed within the body portion;

a contact member comprising a circumferential portion and a plurality of protruding members, wherein:

the contact member is electrically conductive;

an outer surface of the circumferential portion is at least partially disposed within the bore at the first end of the body portion; and the plurality of protruding members each protrude from the circumferential portion toward the second end of the body portion within the bore and extends into the braided outer conductor layer and between the insulator layer and the outer layer of the co-axial cable;

an inner sleeve at least partially disposed within the circumferential portion of the contact member;

a rotatable coupling nut rotatably coupled to the inner sleeve, wherein the rotatable coupling nut is electrically conductive and is electrically coupled to the contact member, and the inner conductor of the co-axial cable is disposed within the rotatable coupling nut; and a conductor retaining member centrally disposed within the inner sleeve, wherein the inner conductor of the co-axial cable is positioned through the conductor retaining member such that the inner conductor is restricted from passing through the conductor retaining member in a direction away from the rotatable coupling nut.

22. The co-axial cable assembly of claim 21, wherein:

the conductor retaining member comprises a central aperture and a plurality of radial openings that define a plurality of flexible protrusions;

the inner conductor of the co-axial cable is positioned through the central aperture of the conductor retaining member; and the plurality of flexible protrusions prevents movement of the inner conductor in the direction away from the first end of the body portion.

23. The co-axial cable assembly of claim 21, further comprising an insulator member comprising an outer surface and an internal bore, wherein:

at least a portion of the outer surface contacts an inner surface of the inner sleeve; and the conductor retaining member is disposed within the internal bore of the insulator member.

24. The co-axial cable assembly of claim 21, wherein:

the circumferential portion of the contact member comprises a first end and a second end;

the at least one protruding member comprises a plurality of protruding members that protrudes from the first end of the circumferential portion and extends into the braided outer conductor layer between the insulator layer and the outer layer of the co-axial cable;

the contact member further comprises a plurality of contacting tabs extending from the second end of the circumferential portion; and the plurality of contacting tabs contact an interior surface of the rotatable coupling nut to electrically couple the at least one protruding portion of the contact member to the rotatable coupling nut.

25. A connector for connecting to a co-axial cable, the connector comprising:

a body portion comprising a first end and a second end, the body portion defining a bore;

a contact member comprising:

a circumferential portion having a first end and a second end;

a plurality of protruding members protruding from the first end of the circumferential portion into the bore defined by the body portion; and a plurality of contacting tabs extending from the second end of the circumferential portion, wherein:

the contact member is electrically conductive; and an outer surface of the circumferential portion is at least partially disposed within the bore at the first end of the body portion;

an inner sleeve at least partially disposed within the circumferential portion of the contact member;

a rotatable coupling nut rotatably coupled to the inner sleeve and comprising an interior surface, wherein the rotatable coupling nut is electrically conductive and the plurality of contacting tabs contact the interior surface of the rotatable coupling nut; and a conductor retaining member centrally disposed within the inner sleeve, the conductor retaining member configured to receive an inner conductor of the co-axial cable such that the inner conductor is free to pass through the conductor retaining member in a first direction toward the first end of the body portion, and is restricted from passing through the conductor retaining member in a second direction away from the rotatable coupling nut.

* * * * *